US012747127B2

(12) United States Patent
Dettori et al.

(10) Patent No.: US 12,747,127 B2
(45) Date of Patent: Sep. 29, 2026

(54) ADVANCEMENT UNIT OF SHEETS OF PAPER IN A MACHINE FOR PAPER CONVERTING AND RELATED ADVANCEMENT METHOD

(71) Applicant: VALMET TISSUE CONVERTING S.r.l., Porcari (IT)

(72) Inventors: Daniele Dettori, Verciano (IT); Daniele Damiani, Coreglia Antelminelli (IT); Massimo Bianchi, Viareggio (IT); Graziano Dini, Bagni di Lucca (IT)

(73) Assignee: VALMET TISSUE CONVERTING S.R.L., Porcari (IT)

( * ) Notice: Subject to any disclaimer, the term of this patent is extended or adjusted under 35 U.S.C. 154(b) by 0 days.

(21) Appl. No.: 18/860,590

(22) PCT Filed: Apr. 27, 2023

(86) PCT No.: PCT/IB2023/054344
§ 371 (c)(1),
(2) Date: Oct. 25, 2024

(87) PCT Pub. No.: WO2023/209621
PCT Pub. Date: Nov. 2, 2023

(65) Prior Publication Data

US 2025/0326603 A1 Oct. 23, 2025

(30) Foreign Application Priority Data

Apr. 28, 2022 (IT) ..... 102022000008450

(51) Int. Cl.
*B65H 45/28* (2006.01)
*B65H 45/24* (2006.01)

(52) U.S. Cl.
CPC ..... *B65H 45/28* (2013.01); *B65H 45/24* (2013.01); *B65H 2301/44331* (2013.01);
(Continued)

(58) Field of Classification Search
CPC ..... B65H 45/28; B65H 45/24; B65H 2301/44331; B65H 2301/44336;
(Continued)

(56) References Cited

U.S. PATENT DOCUMENTS 1,957,621 A * 5/1934 Styron ..... B65H 29/32 144/242.1
2,420,525 A * 5/1947 Deloye ..... B65H 45/24 225/96

(Continued)

FOREIGN PATENT DOCUMENTS

EP 0 291 211 A2 11/1988
EP 1 520 822 A2 4/2005

(Continued)

*Primary Examiner* — Robert F Long
*Assistant Examiner* — Eduardo R Ferrero
(74) *Attorney, Agent, or Firm* — Maschoff Brennan

(57) ABSTRACT

An advancement unit (1) for causing a plurality of sheets (5) of paper, or any other material permeable to air, to move along a predetermined advancing direction (101) in a machine for paper converting, comprises a cutting group (10) which divides a web (4) made of paper, or another material permeable to air, into the sheets (5). The advancement unit (1), furthermore, provides a transfer roll (20) positioned downstream del cutting group (10), having an external surface (25) and adapted to rotate at a first predetermined angular velocity (ω1) about a longitudinal rotation axis (120) and to hold, alternately, on a first and on a second predetermined portion (26, 27) of the external surface (25) the head edge (5*a*) and the tail edge (5*b*) of the sheets (5) coming from the cutting group (10). A displacement group (30) is, furthermore, positioned downstream of the transfer roll (20) to move a plurality of catching members (35) along a movement trajectory (130) comprising at least one curvilinear portion (131) and at least one straight portion (132) to
(Continued)

move the sheets (5) in a partly overlapped configuration along a predetermined advancement trajectory (135).

24 Claims, 21 Drawing Sheets

(52) U.S. Cl.
CPC ..... *B65H 2406/3221* (2013.01); *B65H 2406/344* (2013.01); *B65H 2701/1924* (2013.01)

(58) Field of Classification Search
CPC ..... B65H 2406/344; B65H 2406/3221; B65H 2701/1924; B65H 2701/1311; B65H 29/6618; B65H 29/241
See application file for complete search history.

(56) References Cited

U.S. PATENT DOCUMENTS 3,034,780 A * 5/1962 Stelling, Jr. ..... B65H 45/24 270/39.07
3,490,762 A 1/1970 Nystrand
3,628,654 A * 12/1971 Haracz ..... B65G 17/46 198/689.1
3,659,839 A * 5/1972 Baucke ..... B65H 29/6627 271/183
4,494,741 A * 1/1985 Fischer ..... B65H 31/24 83/100
4,521,209 A * 6/1985 DuFresne ..... B65H 45/165 493/450
4,917,665 A * 4/1990 Couturier ..... B65H 45/24 493/359
5,687,641 A * 11/1997 Williamson ..... B65H 29/32 99/450.2
6,213,927 B1 * 4/2001 De Matteis ..... B65H 45/24 493/359
6,228,014 B1 5/2001 De Matteis et al.
11,274,006 B2 * 3/2022 Veis ..... B65G 21/2036
2004/0159999 A1 * 8/2004 Dematteis ..... B65H 45/24 271/264
2006/0181005 A1 * 8/2006 Lapointe ..... B65H 29/241 271/194
2009/0289407 A1 11/2009 De Matteis
2010/0025918 A1 * 2/2010 Miyazawa ..... G03G 15/657 271/98
2010/0259590 A1 * 10/2010 DeGruchy ..... B41J 11/007 347/104
2010/0276868 A1 * 11/2010 Moore ..... B41J 11/007 271/108
2013/0036887 A1 * 2/2013 Moore ..... B65G 47/843 198/470.1
2013/0215204 A1 * 8/2013 Inoue ..... B41J 13/226 347/104
2015/0018188 A1 * 1/2015 Jamar ..... B26D 5/34 493/344
2017/0368781 A1 12/2017 Bretting
2018/0305157 A1 * 10/2018 Veis ..... B65H 11/005
2018/0339529 A1 * 11/2018 Zirilli ..... B41J 11/0085

FOREIGN PATENT DOCUMENTS

EP 1 820 763 A1 8/2007
EP 1 457 444 B1 11/2011
WO 2011/015893 A1 2/2011

* cited by examiner

ADVANCEMENT UNIT OF SHEETS OF PAPER IN A MACHINE FOR PAPER CONVERTING AND RELATED ADVANCEMENT METHOD

FIELD OF THE INVENTION

The present invention relates to the field of the machines for converting paper and similar products, and in particular it relates to an advancement unit of sheets of paper and similar products in a machine for paper converting, in particular interfolding machines and folding machines.

Furthermore, the invention relates to a method for causing the aforementioned sheets of paper to advance through the machines for paper converting.

DESCRIPTION OF THE PRIOR ART

As it is known, many machines are used in the paper industry, such as interfolding, folding, machines and other machines for producing packages of tissues, towels and similar articles are provided with systems for causing the sheets of paper to advance along a predetermined path in such a way to subject them to determined working processes.

In particular, these systems are used for carrying out the main the fundamental operations of paper cutting, or the transfer from a device to another one.

In particular, the interfolding machines work one or more webs of paper coming from one or more reels which are cut at a cutting unit into sheets of predetermined length and fed staggered to each other to a folding unit at which 2 counter-rotating folding rolls work. More precisely, the cut into sheets of the veils is carried out on cutting rolls provided with cutting blades which alternatively interact with respective counter-blades.

Among the possible ways to fold the sheets are known, in particular, the "V", "L" interfolded, with 2 panels, the "Z" interfolded with 3 panels, and the "W" interfolded with 4 panels.

In the case of "L" or "V" interfolded, which are obtained by the so-called "single-fold" machines, of the type for example described in U.S. Pat. No. 6,228,014, the webs of paper are cut in such a way to form two staggered sequences of sheets that are alternately fed to the folding rolls. In this way, each sheet coming from a first direction is superimposed, for about half sheet, on a portion of the sheet coming from a second direction, and vice versa, at the moment at which the fold is carried out.

In the case of "Z" or "W" interfolded or also having more panels, obtained by the so-called "multifold" machines of the type for example described in U.S. Pat. No. 3,490,762, a single web of paper is worked and at the folding rolls a sequence of sheets already partly superimposed to each other arrives from only one direction. As described in EP1520822, the overlap between two following sheets is, normally, carried out immediately after the cut by a transfer roll and a delay roll, which form together a small bend at a sheet below which a portion of a following sheet positions.

Both in the single-fold machines, and in the multi-fold machines, the folding rolls have a circumference whose length is a multiple of the length of the panel. In particular, in order to be able to carry out the folding or interfolding of the sheets, the folding rolls are provided with holding devices, such as suction holes, or mechanical pliers, which are synchronously activated to alternately begin and complete each fold between two successive panels.

In the last years, in the field of paper converting machines, systems have become widely spread for causing the sheets of paper to advance, suction rolls provided with pneumatic systems which cause the worked sheet or web of paper to be sucked and to adhere on a determined portion of the external lateral surface of the suction roll. More precisely, as described for example in EP1457444, or in EP2514698, the aforementioned suction systems provide a device for generating a determined vacuum degree, which is pneumatically connected to the interior of the suction rolls. More precisely, a suction roll of this type comprises a movable tubular body adapted to rotate about a longitudinal rotation axis and a fixed tubular body coaxially arranged with respect to the movable tubular body. The surface of the movable tubular body is provided with a determined number of couples of longitudinal rows of suction holes, normally 3 or 4, couples of rows of holes. Between the movable tubular body and the fixed tubular body a vacuum distribution device is provided comprising a first and a second sealing element, or gasket, which are positioned longitudinally to the suction roll at two different angular positions. In this way, during the rotation of the movable tubular body with respect to the fixed tubular body, the aforementioned rows of holes are selectively pneumatically connected to the aforementioned vacuum generation device by the aforementioned vacuum distribution device. More precisely, only the holes of the roll that, at a determined instant, are arranged between two sealing elements will exert a sucking action on the worked sheet or web of paper, thus causing the same to adhere on the corresponding portion of the external lateral surface of the suction roll.

However, the devices which are used to cause the partly superimposed sheets of paper to advance along the paper converting machines have some drawbacks.

Firstly, the prior art machines, for example described in EP1820763, US2009/289407, EP0291211 and US2017/368781, have productivity limits mainly due to the systems which carry out the partial superimposition of the sheets upstream of the folding rolls that are not able to work at speeds higher than a determined threshold value without compromising the quality of the final product, in particular in terms of the portion of the sheets of paper where are superimposed to each other.

SUMMARY OF THE INVENTION

It is, therefore, an object of the present invention to provide an advancement unit of sheets of paper that is able to overcome the drawbacks of analogous systems of prior art and in particular that is able to increase the productivity of the paper converting machines which adopt the same.

It is also an object of the invention to provide a method for producing products made of paper having the same advantages.

These and other objects are achieved by an advancement unit configured to cause a plurality of sheets of paper, or other material permeable to air, of predetermined length to advance along a predetermined advancing direction in a machine for paper converting, each sheet of said plurality having a head edge and a tail edge, said advancement unit comprising:

- a cutting group configured to divide a web made of paper, or another material permeable to air, in said plurality of sheets;
- a transfer roll positioned downstream of said cutting group and having an external surface, said transfer roll being configured to rotate at a first predetermined angular velocity about a longitudinal rotation axis, and to alternately hold on a first and on a second predetermined portion di said external surface, respectively said head edge and said tail edge di said plurality of sheets coming from said cutting group, in such a way to cause said sheets to be transferred at a first predetermined tangential speed v1;

whose main characteristic is that it, furthermore, provides:

a displacement group positioned downstream of said transfer roll and configured to move a plurality of catching members along a movement trajectory comprising at least one curvilinear portion and at least one straight portion, each catching member being configured to hold a respective head edge of a sheet of paper during its movement along said predetermined movement trajectory, in such a way to move said plurality of sheets in a partly overlapped configuration along a predetermined advancement trajectory.

Other technical characteristics of the present invention are defined by the dependent claims.

In particular, the aforementioned curvilinear portion of the movement trajectory can be positioned upstream of the aforementioned straight portion.

More in particular, the plurality of catching members can be moved along the curvilinear portion at a second tangential speed v2 slower than or equal to a first tangential speed v1. This, as known, is related to the aforementioned first angular velocity ω1 by the known equation $v1=\omega1 \cdot r1$, where r1 is the radius of the covered curvilinear path.

In this way, it is possible to obtain the aforementioned plurality of sheets arranged in the aforementioned partly overlapped configuration at the displacement group.

Advantageously, each catching member can comprise a main body provided with at least a catching hole.

In particular, the or each catching hole can be configured to suck a head edge of a respective sheet of the aforementioned plurality and keep the same on a predetermined advancement trajectory. More in particular, the catching hole can be adapted to hold the head edge of the sheet on a catching surface of the aforementioned main body, advantageously during the movement of the respective catching member on the predetermined movement trajectory. In an embodiment of the invention, the or each catching hole is adapted to pneumatically communicate with a device for generating a predetermined vacuum degree at predeterminate positions.

In particular, the transfer roll can comprise a tubular body provided with the external lateral surface and with an internal lateral surface pneumatically communicating with each other through a plurality of suction holes organized according to a plurality of suction groups each comprising a first of which longitudinal row of suction holes adapted to suck the aforementioned head edge of a sheet of paper and at least a second longitudinal row of suction holes adapted to suck a tail edge of a previous sheet of paper of the aforementioned plurality.

More in particular, the transfer roll can be, furthermore, provided with an actuation group configured to cause the aforementioned suction, respectively, of a head edge and of a tail edge by the first and the second longitudinal row of suction holes only at predetermined respective angular positions of the tubular body.

In a possible embodiment provided, the aforementioned actuation group can be configured to selectively put in communication the holes of the first and the second longitudinal row of suction holes with a device for generating a determined vacuum degree at the aforementioned respective angular positions of the tubular body.

In an embodiment of the invention, the aforementioned actuation group can comprise:

a first actuation device configured to cause each first longitudinal row of suction holes of each suction group to suck at least between the catching point (P1) and the first releasing point (P1') going in the direction of rotation of the transfer roll about the longitudinal rotation axis;

a second actuation device configured to cause each said second longitudinal row of suction holes of each suction group to suck at least between the catching point (P1) and the second releasing point (P2') going in the direction of rotation of the transfer roll about the longitudinal rotation axis.

In particular, each catching member can be adapted to engage a motion transmission member moved along the aforementioned movement trajectory. More in particular, each catching member can be adapted to protrude from the aforementioned motion transmission member for a predetermined height L and comprises a plurality of suction holes positioned parallel to the longitudinal rotation axis of the transfer roll.

In an embodiment according to the invention, the motion transmission member can be of flexible type.

In particular, the motion transmission member of flexible type can be wound between a first guide element and a second guide element.

Advantageously, one between the first and the second guide element can be of motorized type.

In an alternative embodiment, each catching member can be associated to a respective displacement device. In this case, therefore, each catching member can be moved independently from the others. In particular, a control group can be provided configured to operate each displacement device in order to synchronize the movements of the different catching members along the movement trajectory.

According to another aspect of the invention, a machine for converting a web or sheet of paper, or any other material permeable to air, comprises at least a transfer unit as described above.

According to a further aspect of the invention, an interfolding machine for producing folded or interfolded products comprises:

an advancement unit as described above;

a couple of folding rolls positioned downstream of the displacement group and adapted to fold or interfold the aforementioned plurality of sheets of paper at least partly superimposed forming a stack of folded or interfolded sheets.

According to still another aspect of the invention, a method for causing a plurality of sheets of paper, or any other material permeable to air, having a predetermined length to advance along a predetermined advancing direction in a machine for paper converting, each sheet of paper of said plurality having a head edge and a tail edge, said method comprising the steps of:

dividing by a cutting group a web made of paper, or another material permeable to air, into said plurality of sheets of paper;

transferring by a transfer roll positioned downstream of said cutting group and having an external surface, said plurality of sheets of paper from said cutting group to a displacement group positioned downstream of said transfer roll, said transfer roll being configured to rotate at a first predetermined angular velocity (ω1) about a longitudinal rotation axis and to hold on a predetermined portion of said external surface said plurality of sheets of paper coming from said cutting group in such a way to cause them to be transferred at said first predetermined tangential speed (v1);

movement by said displacement group of a plurality of catching members along a movement trajectory comprising at least one curvilinear portion and at least one straight portion, each catching member being configured to hold a respective head edge of a sheet of paper and to keep the same on said predetermined movement trajectory.

BRIEF DESCRIPTION OF THE DRAWINGS

The invention will now be shown with the following description of its exemplary embodiments, exemplifying but not limitative, with reference to the attached drawings in which.

DETAILED DESCRIPTION OF SOME EXEMPLARY EMBODIMENTS OF THE INVENTION

Figure 1:
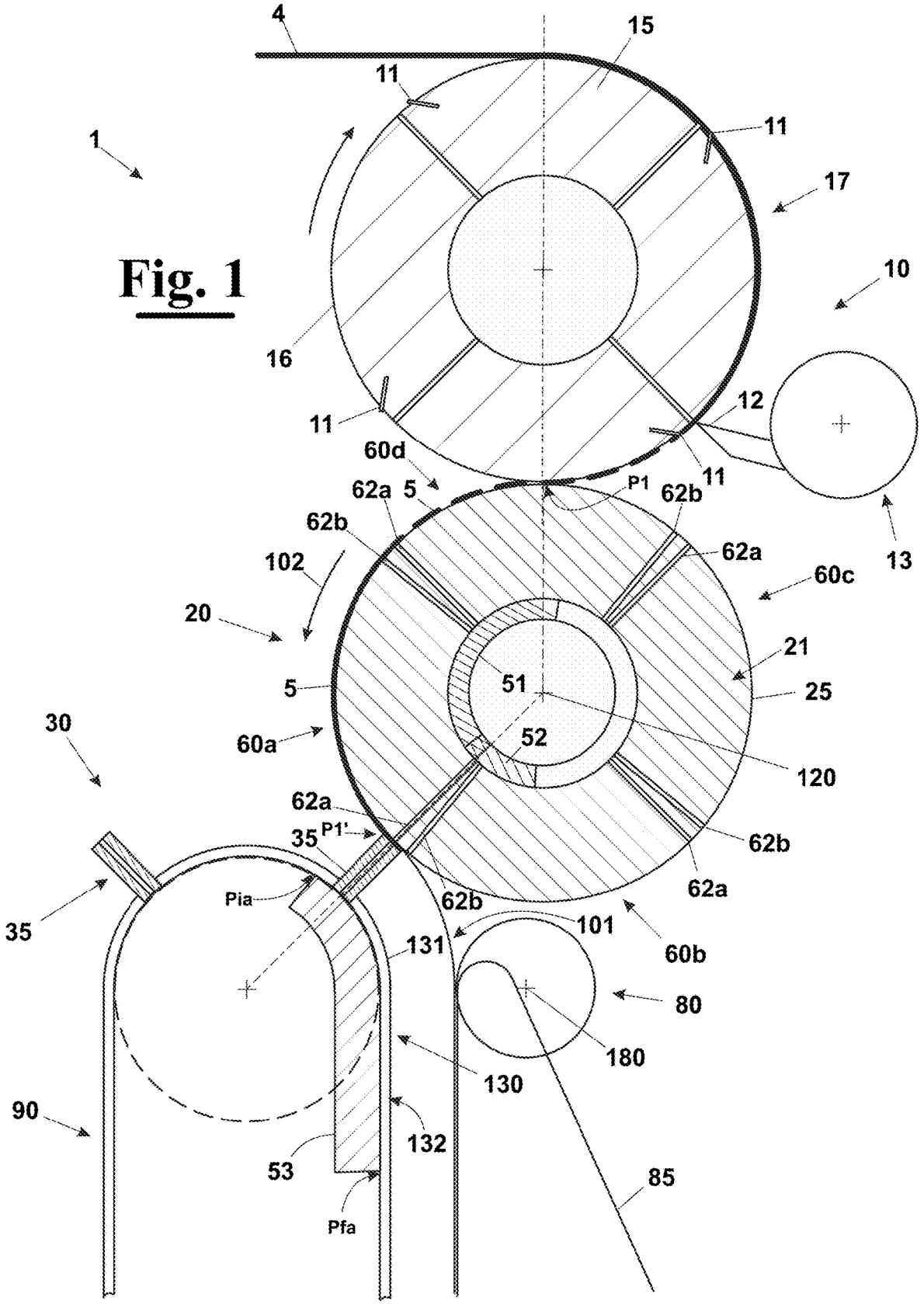
FIG. 1 diagrammatically shows an elevation side view partly sectioned of a first embodiment of an unit, according to the invention, for causing sheets of paper to advance in a machine for paper converting.
Figure 2:
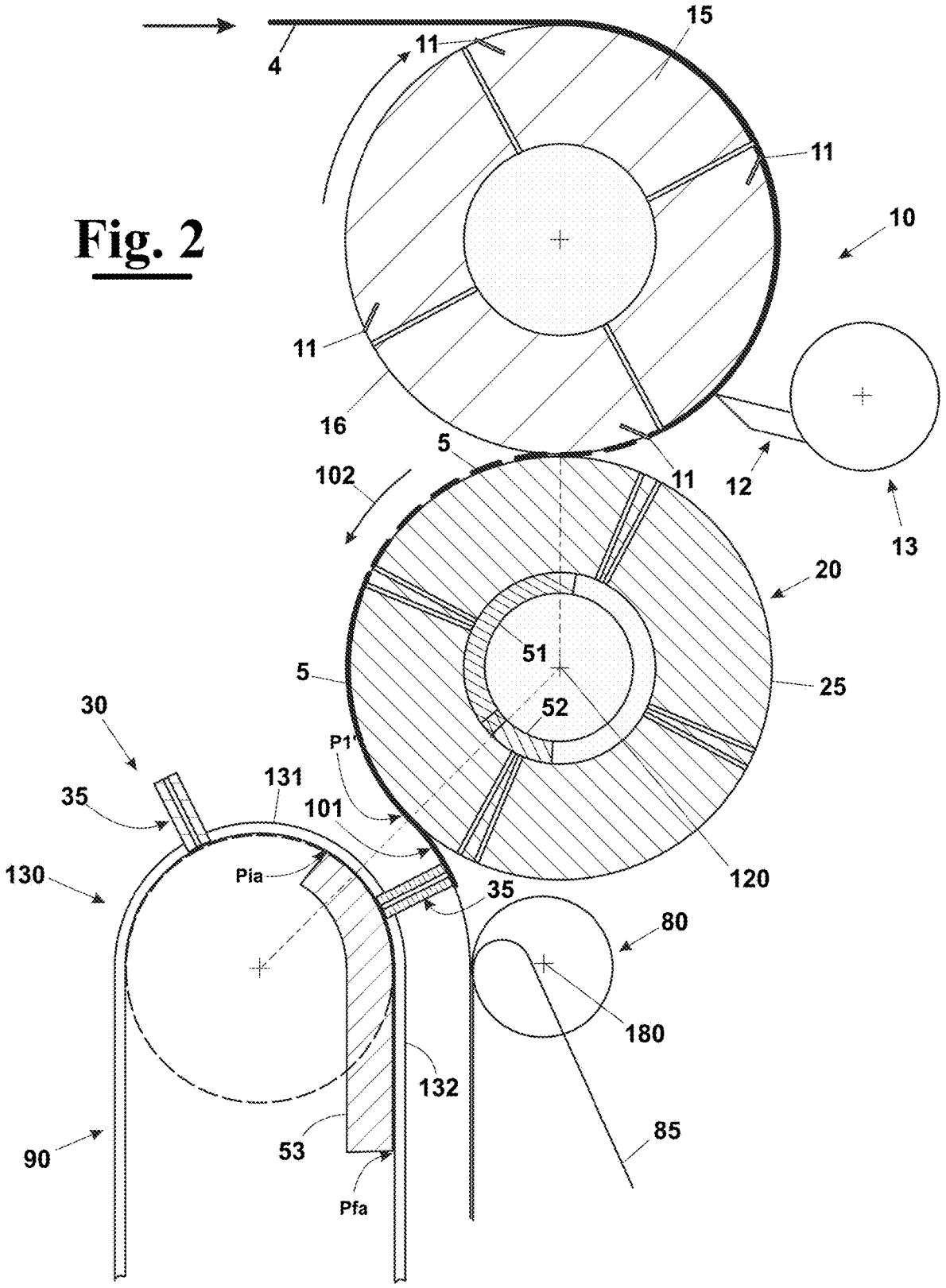
FIGS. 2 to 8 diagrammatically show some instants of the process through which the advancement unit of FIG. 1 causes the sheets of paper to advance along a predetermined trajectory.
Figure 3:
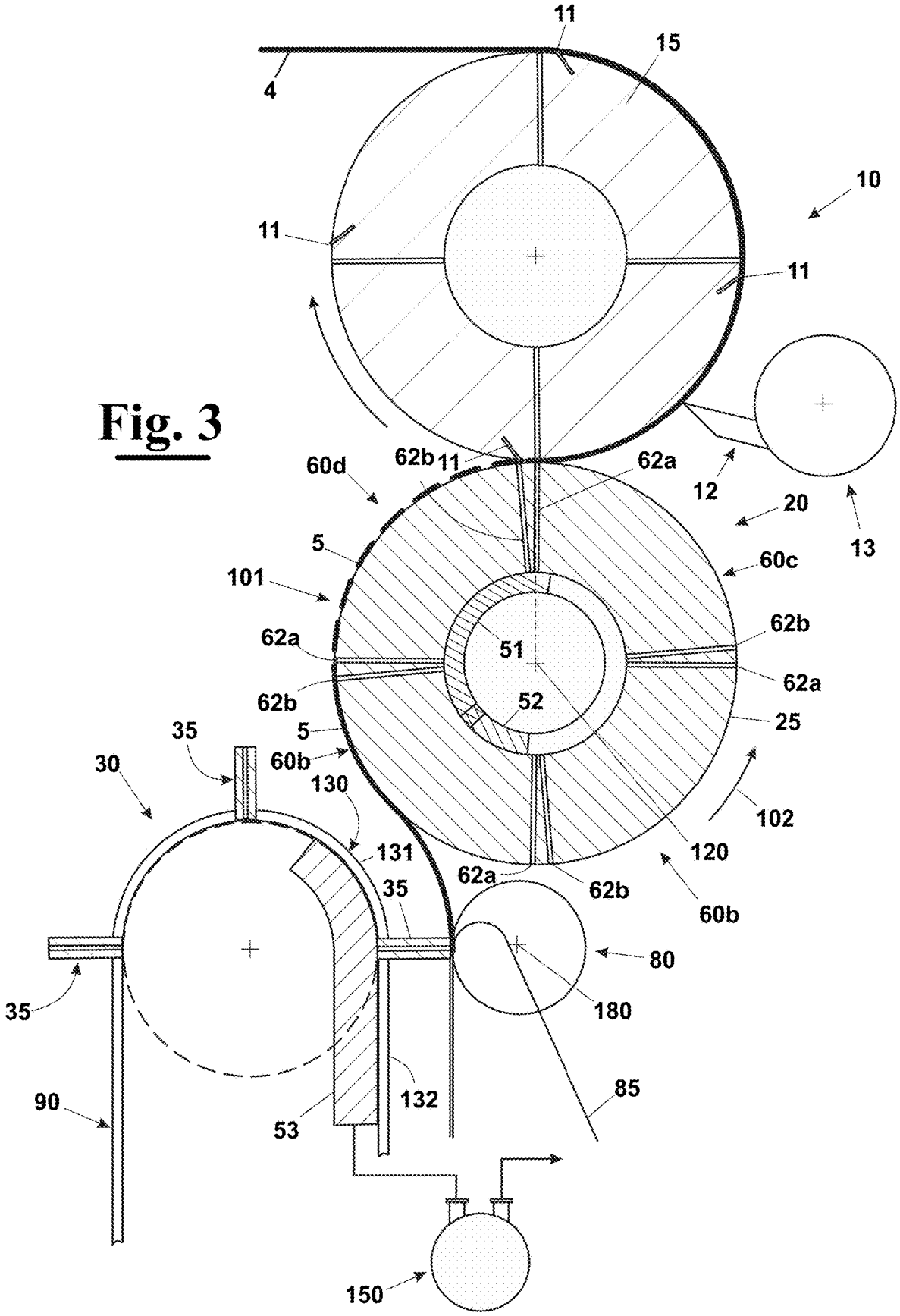
Figure 4:
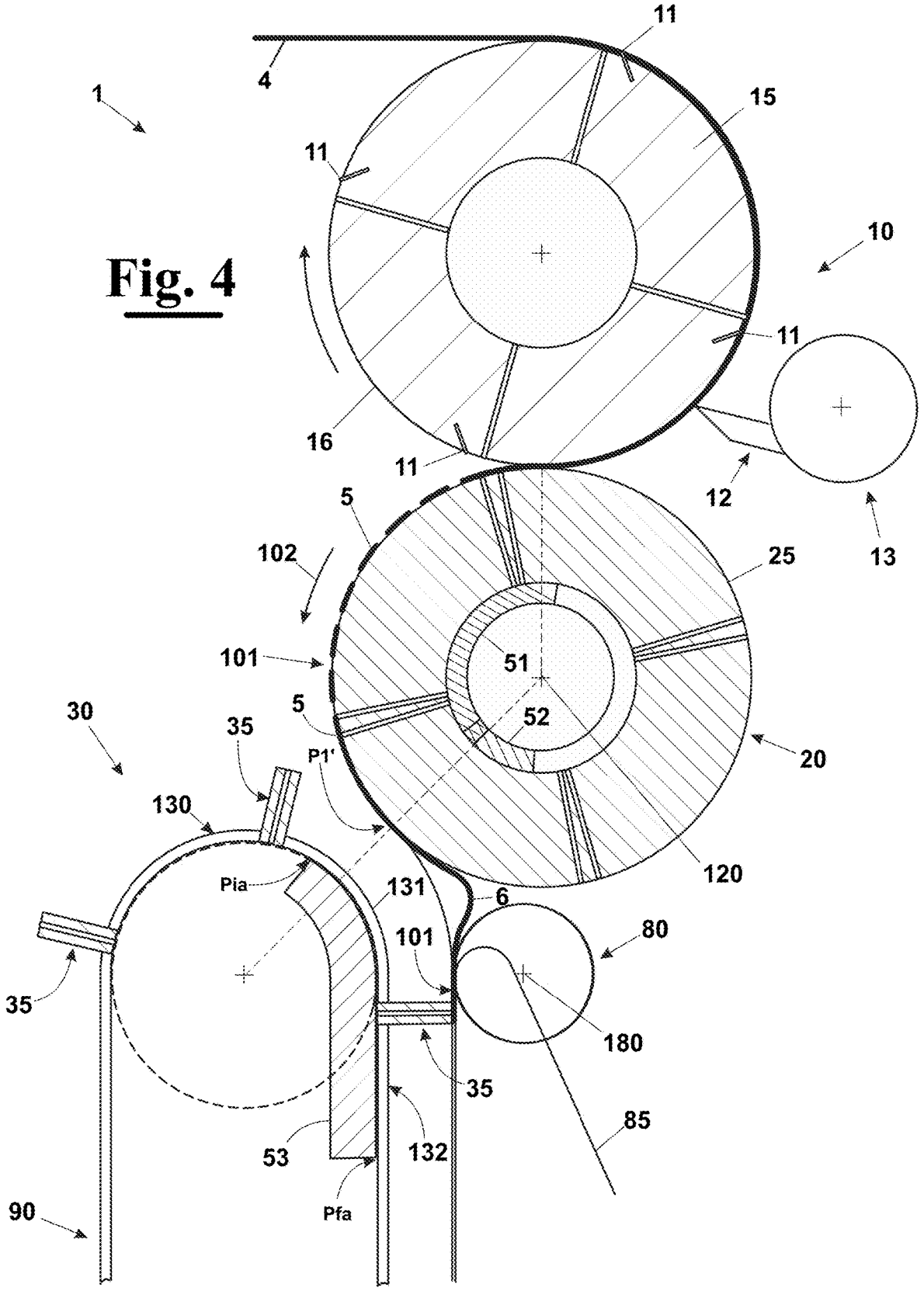
Figure 5:
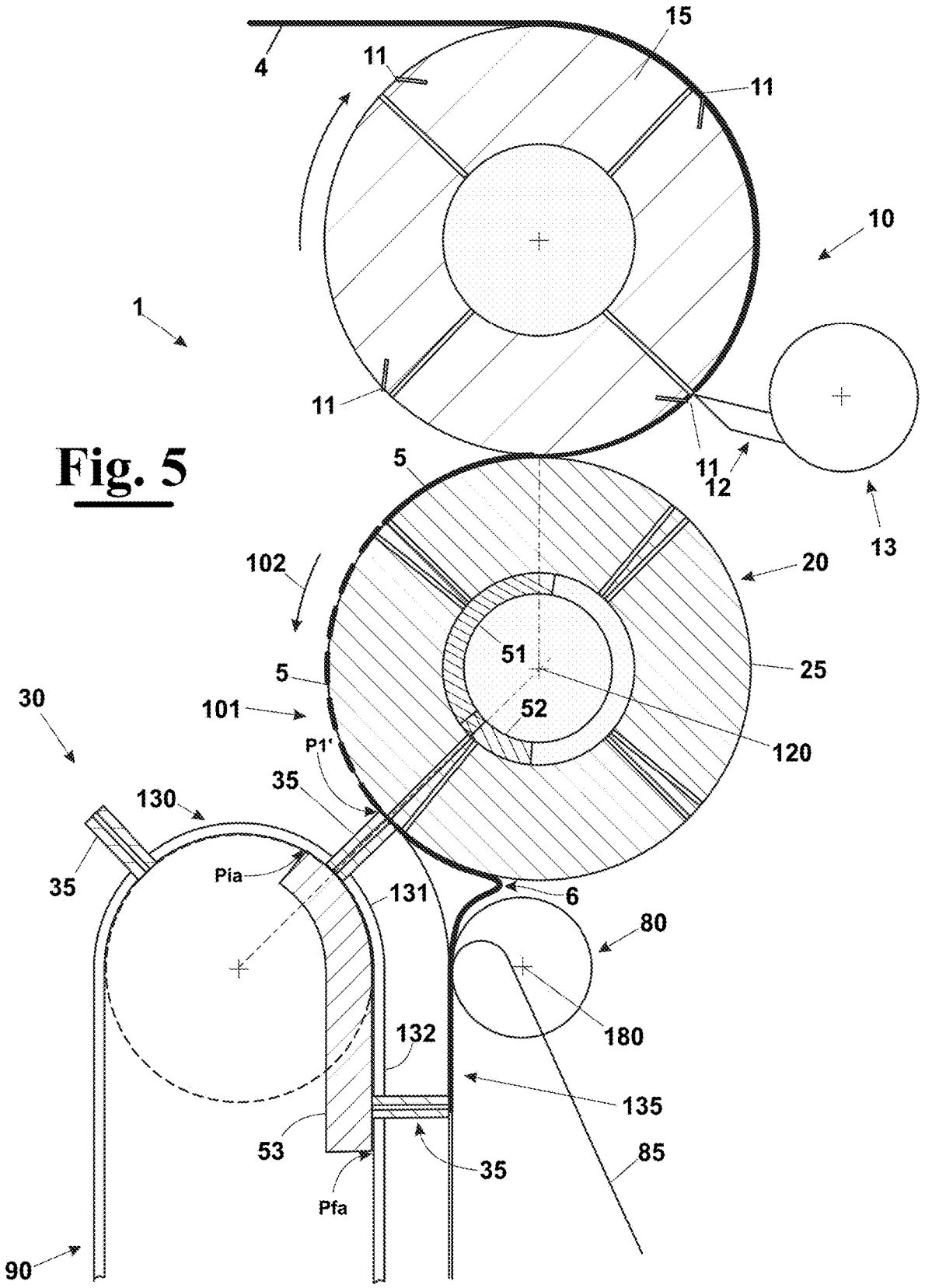
Figure 6:
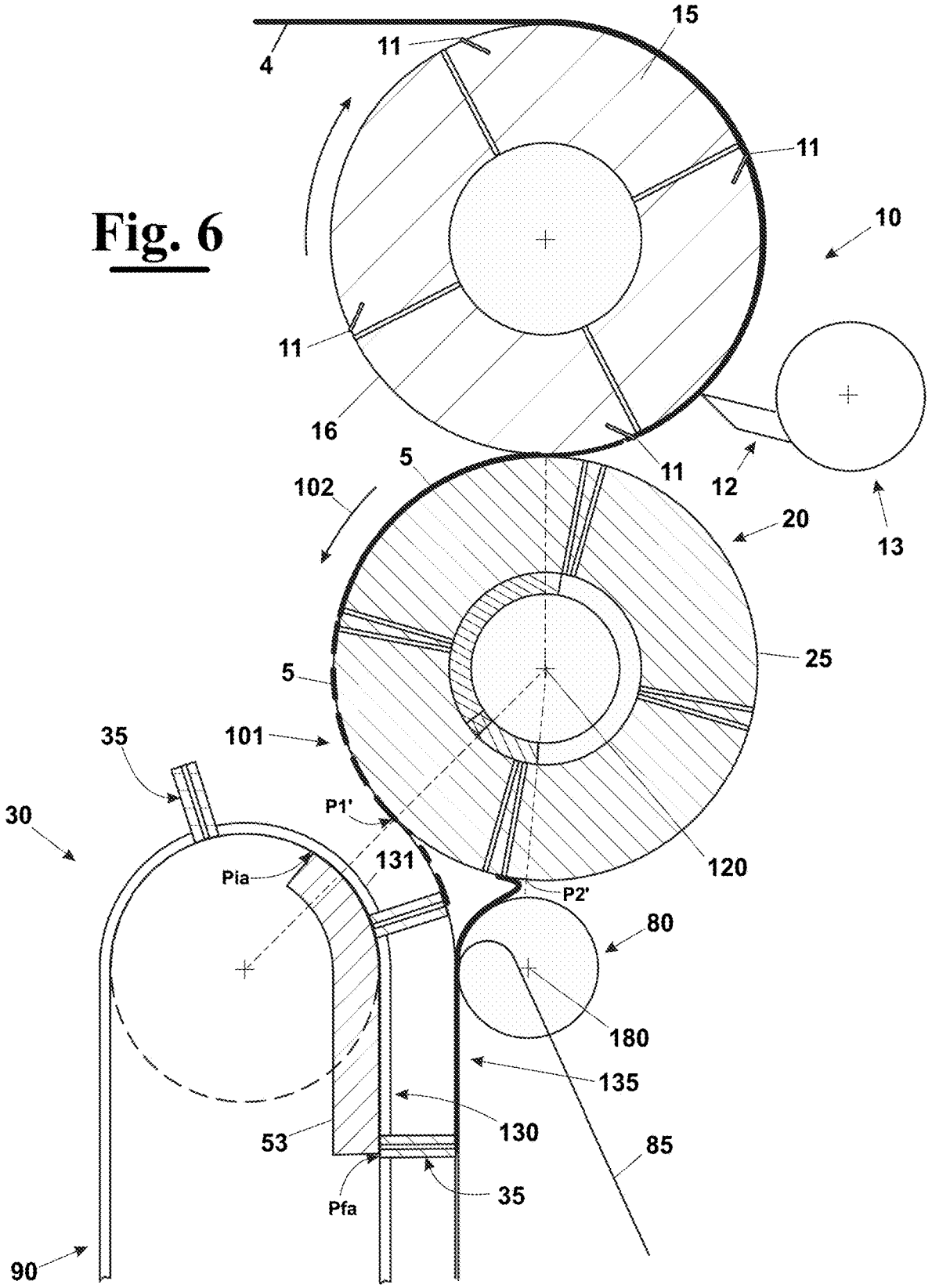
Figure 7:
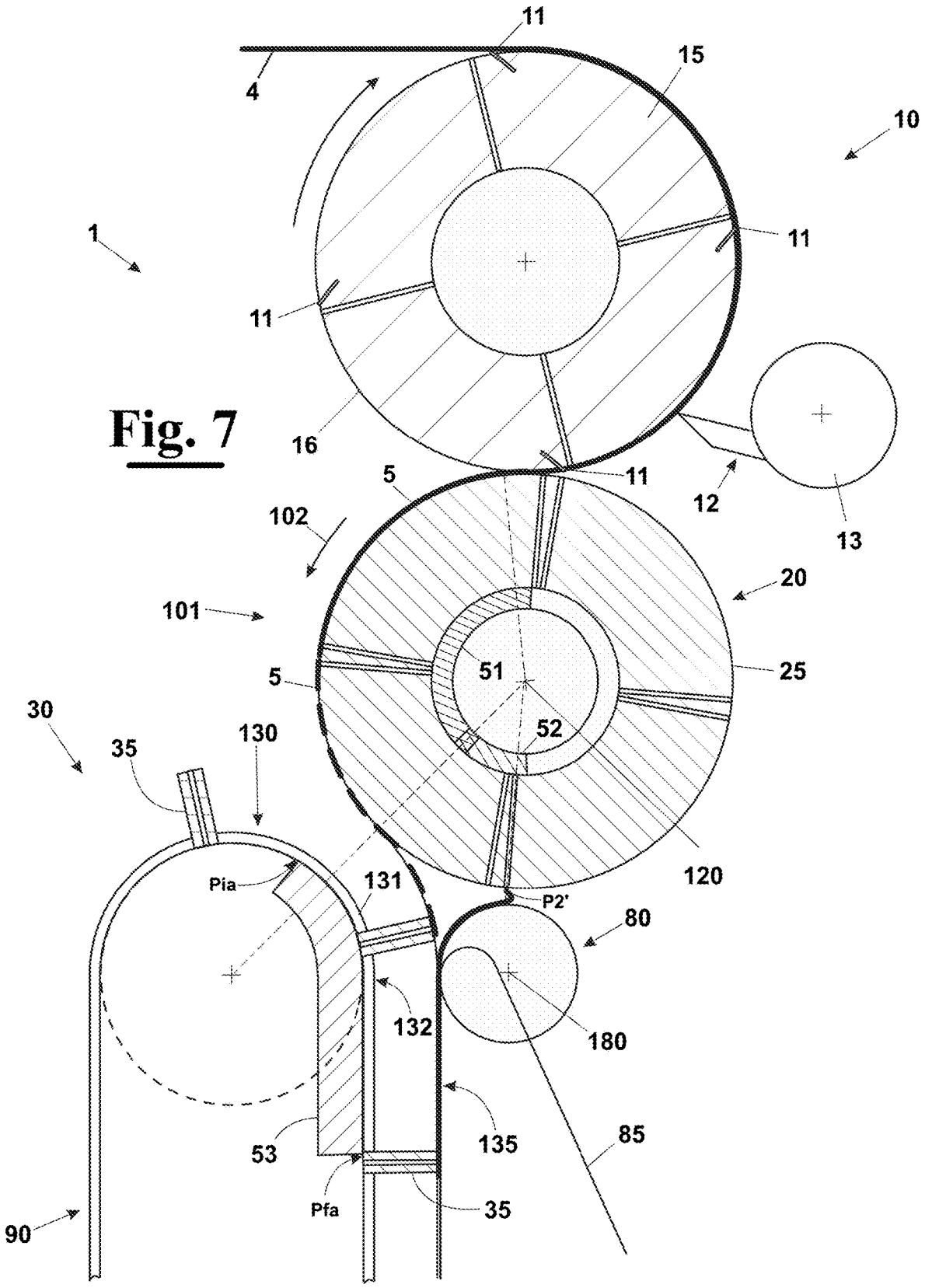

In the figures from 1 to 9 a first embodiment of an advancement unit 1, according to the invention, is diagrammatically shown to cause a plurality of sheets 5, preferably of paper material, for example paper, as well as any other material permeable to air, for example non-woven fabric, or NWF, advantageously arranged in such a way to form a flow of sheets, having a predetermined length L1, to move along a predetermined advancing direction 101 in a machine for converting paper, or any other material permeable to the air. In particular, each sheet 5 has a head edge 5*a* and a tail edge 5*b*.

More in detail, the advancement unit 1 comprises a cutting group 10 configured to divide a continuous web 4 of paper, or any other material permeable to air, into the aforementioned plurality of sheets 5. In particular, the cutting group 10 can provide a cutting roll 15 provided with a series of cutting blades, for example 4 cutting blades 11, adapted to cooperate with a cutting counter-blade 12 mounted on a support member 13, for example fixed. The cutting roll 15 can be, furthermore, provided with holding elements, advantageously of mechanical type, adapted to hold the sheets 5 on a predetermined portion of the external surface 16 of the roll 15 same, once that the continuous web 4 has been divided into the aforementioned sheets of paper 5. The cutting group 10 can be, in general, of known type, for example of the type described in WO2011015893, or US2011275503, or analogous cutting systems.

The advancement unit 1, according to the invention, furthermore, comprises a transfer roll 20 positioned downstream of the cutting group 10. In particular, the transfer roll 20 has an external surface 25 and is adapted to rotate at a first predetermined angular velocity ω1 about a longitudinal rotation axis 120. More in particular, the transfer roll 20 is adapted to hold alternately on a first predetermined portion 26 and on a second predetermined portion 27 of the external surface 25 the aforementioned plurality of sheets 5 coming from the cutting group 10, in such a way to cause the sheets 5 to advance at a first predetermined advancement speed, in particular a tangential speed v1.

According to what is provided by the present invention, the advancement unit 1, furthermore, comprises a displacement group 30 positioned downstream of the transfer roll 20. In particular, the displacement group 30 is adapted to move a plurality of catching members 35 along a movement 25 trajectory 130 comprising at least one curvilinear portion 131 and at least one straight portion 132. Each catching member 35, in particular, is adapted to hold a respective head edge 5*a* of a sheet of paper 5 and to keep the same on the predetermined movement trajectory 130. In particular, the movement trajectory 130 can be a closed trajectory (see FIGS. 19 and 20) comprising two curvilinear portions 131 linked by two straight portions 132.

As diagrammatically shown for example in FIG. 1, the curvilinear portion 131 of the movement trajectory 130 is positioned upstream of the straight portion 132, going in the direction along which the catching members 35 are moved.

In particular, the catching members 35 at the curvilinear portion 131 of the movement trajectory 130 are moved in such a way to have the outermost end at a second tangential speed v1' slower than or equal to a first tangential speed v1 related to the aforementioned first angular velocity ω1 by the known equation v1=ω1·r1, where r1 is the radius of the transfer roll 20.

In an embodiment of the invention, each catching member 35 comprises a main body 33, for example having a polyhedric or prismatic shape, provided with at least a catching hole 37. In particular, the or each catching hole 37 pneumatically communicates with a device for generating a predetermined vacuum degree 150, in such a way to suck a head edge 5*a* of a respective sheet of paper 5 and to keep it, in particular at a catching surface 36, on an advancement trajectory 135. This latter can be defined as the trajectory described by the end of each catching member 35 during the movement of the same along the movement trajectory 130.

With reference, for example, to FIG. 1, the transfer roll 20 can comprise a tubular body 21 provided with the external lateral surface 25 and with an internal lateral surface 28. This latter is pneumatically connected with the external lateral surface 25 through a plurality of suction holes 62 organized according to a predetermined number of suction groups 60, for example 4 suction groups 60*a*-60*d*.

Figure 9:
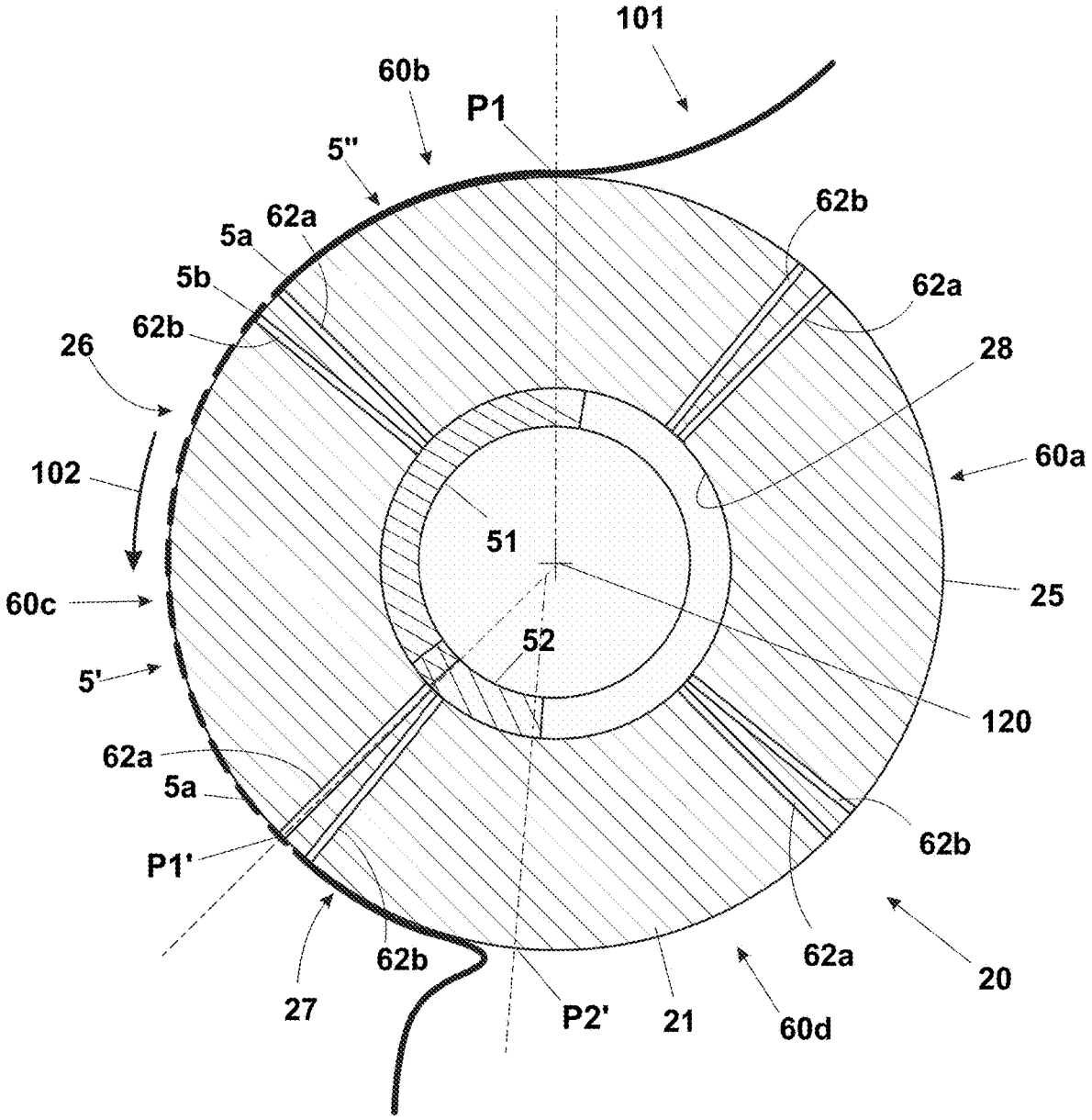
FIG. 9 diagrammatically shows a transversal cross section of an embodiment of a transfer roll that can be used in the advancement unit of FIG. 1.

Advantageously, each suction group 60 comprises a first longitudinal row of suction holes 62*a* adapted to suck the head edge 5*a* of a sheet 5, in FIG. 9 for example the sheet 5", and at least a second longitudinal row of suction holes 62*b* adapted to suck a tail edge 5*b* of a previous sheet 5, in FIG. 9 the sheet 5'.

Figure 10:
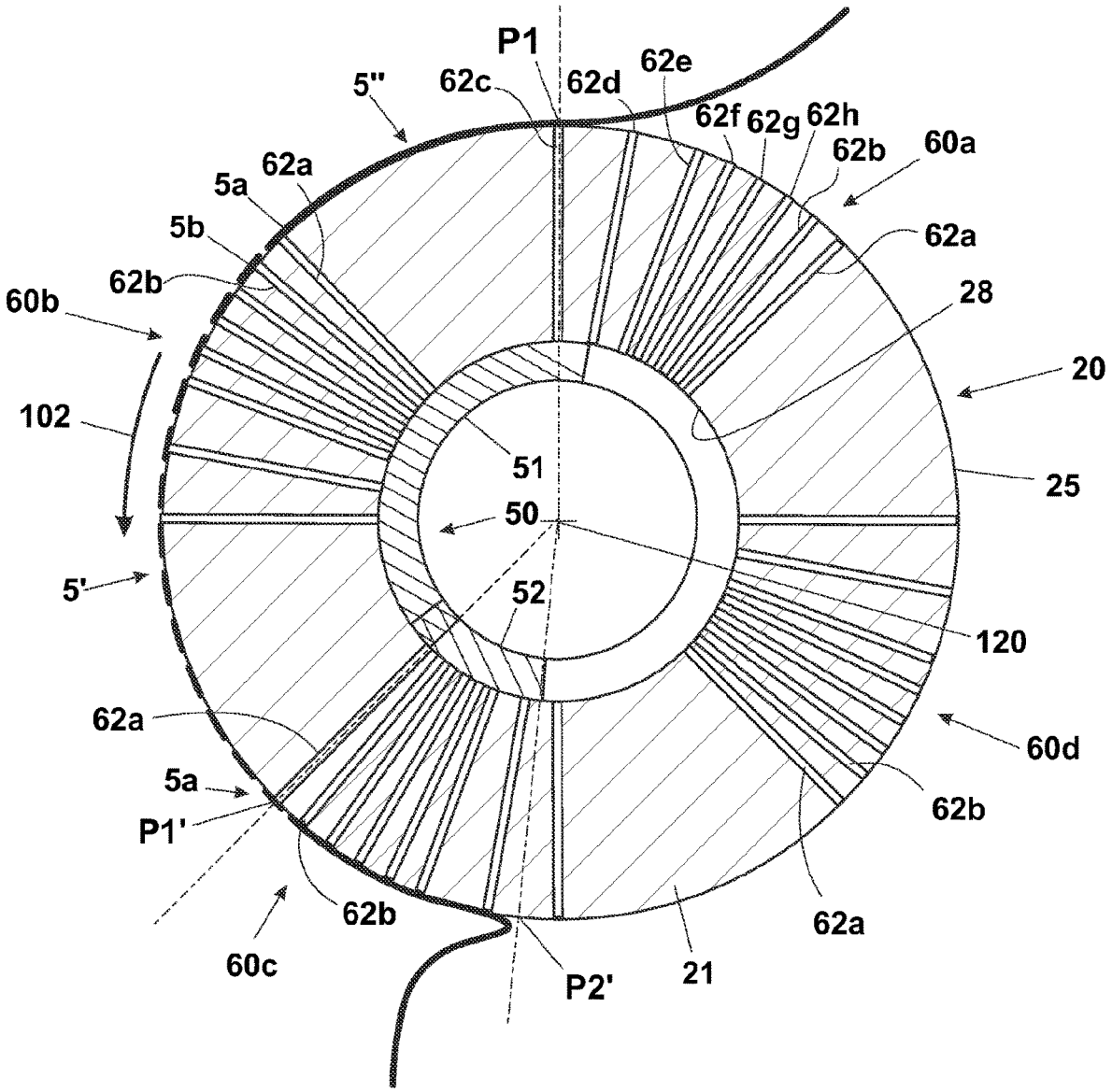
FIG. 10 diagrammatically transversal cross section of an alternative embodiment of the transfer roll of FIG. 9.

However, the possibility is provided that each suction group 60*a*-60*d* can comprise a higher number of suction holes, in particular a number of suction holes n comprised between 2 and 10, for example 8 suction holes 62*a*-62*g* as diagrammatically shown in FIG. 10. More in particular, the suction holes 62*c*-62*g* can be positioned between the hole of the first suction row 62*a* and the hole of the second row 62*b* of each suction group 60 and, advantageously, concentrated upstream of the suction holes of each second suction row 62*b*, in such a way to release each sheet 5 by the transfer roll 20 and to pass the same to the displacement group 30 in a precise and controlled way.

The advancement unit 1 diagrammatically shown in the figures from 1 to 10 can be, in particular, used in a machine for converting paper, or any other material permeable to air, for producing folding or interfolding products with 2 panels, i.e. the so-called "L" or "V" products.

Figure 11A:
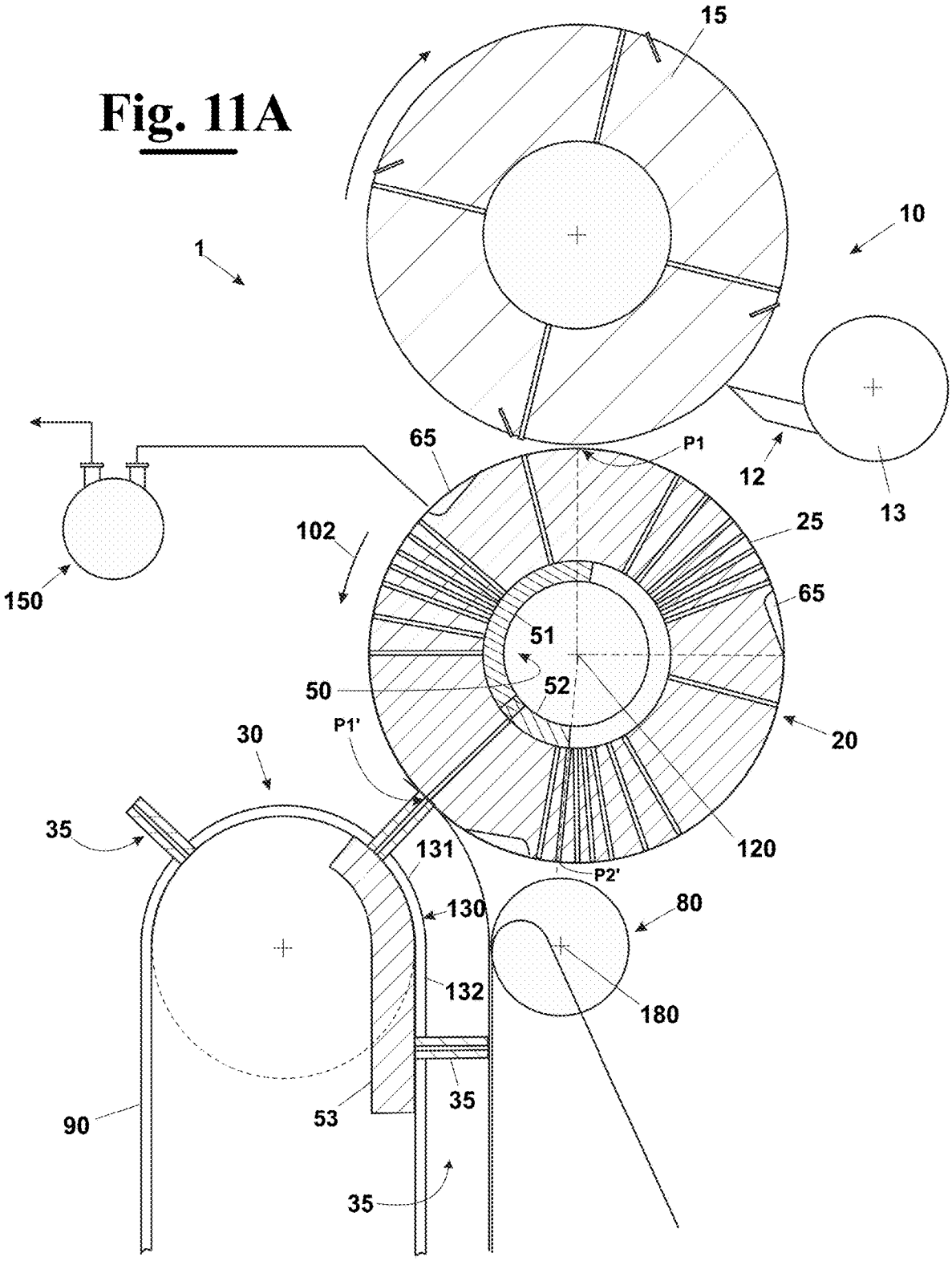
FIGS. 11A and 11B show a further alternative embodiment of the transfer roll of FIGS. 9 and 10 that can be used in the advancement unit according to the invention.
Figure 11B:
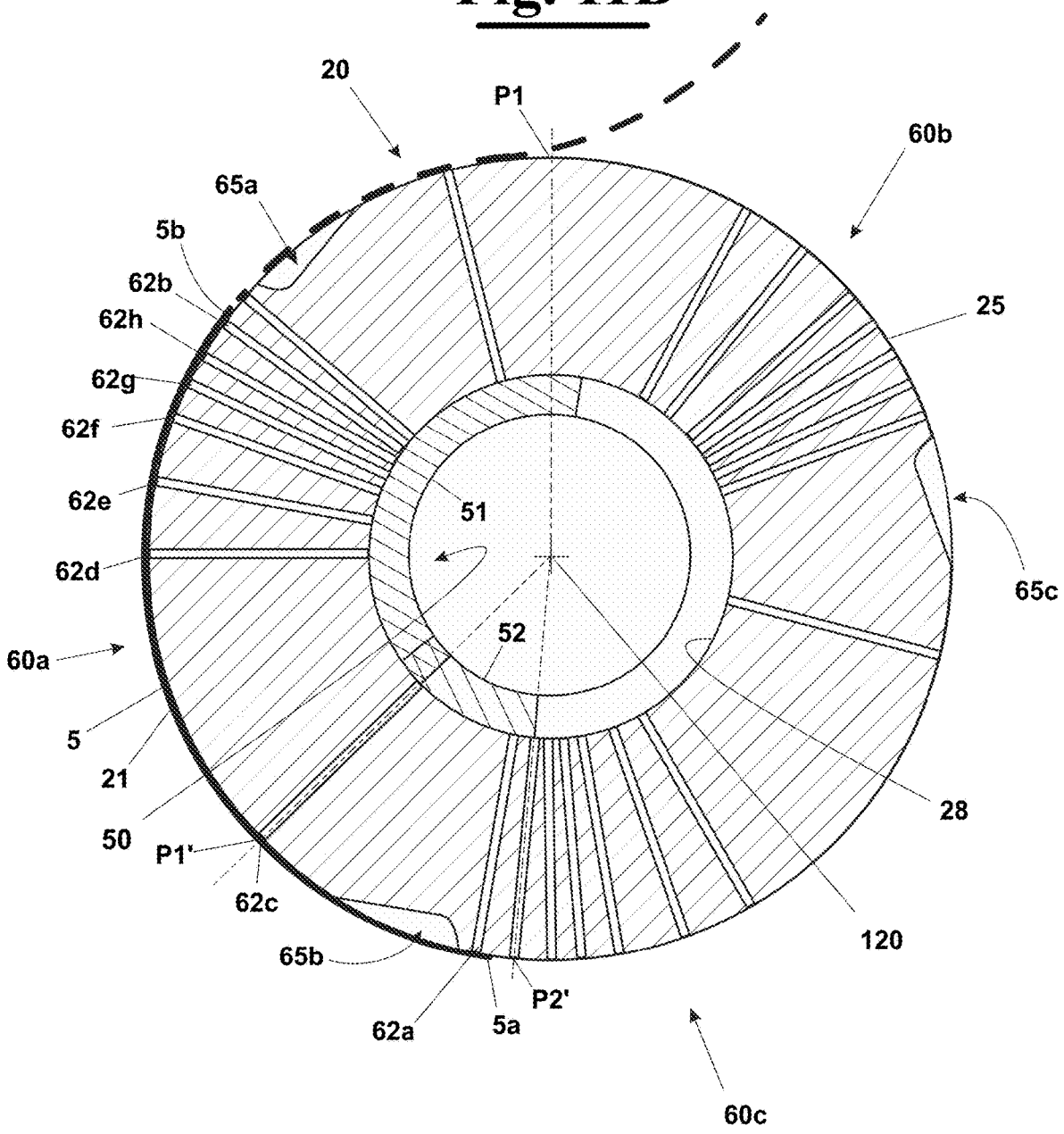

The embodiment diagrammatically shown in the FIGS. 11A and 11B, instead, where the transfer roll 20 is provided with 3 suction groups 60*a*-60*c*, can be used in machines for converting paper, or other materials, for example non-woven fabric, for producing folding or interfolding products with 4 panels, i.e. the so-called "W" products. In particular, as diagrammatically shown in the FIGS. 11A and 11B, the main body 25 of the transfer roll 20 can provide a series of recessed portions, in particular a recessed portion associated to each suction group 60, in the case of FIGS. 11A and 11B where 3 suction groups 60*a*-60*c* are present, 3 recessed portions 65*a*-65*c*, in particular positioned downstream of the first suction hole 62*a* going in the sense of rotation of transfer roll 20, advantageously between the first and the second suction hole 62*a* and 62*c* of the same suction group 60.

The transfer roll 20 is, furthermore, provided with an actuation group 50 configured to selectively cause the first and second longitudinal rows of suction holes 62*a* and 62*b* to be sucked only at predetermined respective angular positions of the tubular body 20. In this way it is possible to cause the head edge 5*a* and the tail edge 5*b* of the worked sheets of paper 5 to be sucked and their adhesion to corresponding portions of the external lateral surface 25 of the transfer roll 20.

In an embodiment foreseen, the aforementioned actuation group 50 can be configured to selectively put in pneumatic connection the holes 62*a* and 62*b* of the first and the second longitudinal row of suction holes with a device for generating a predetermined sucking force.

Figure 8:
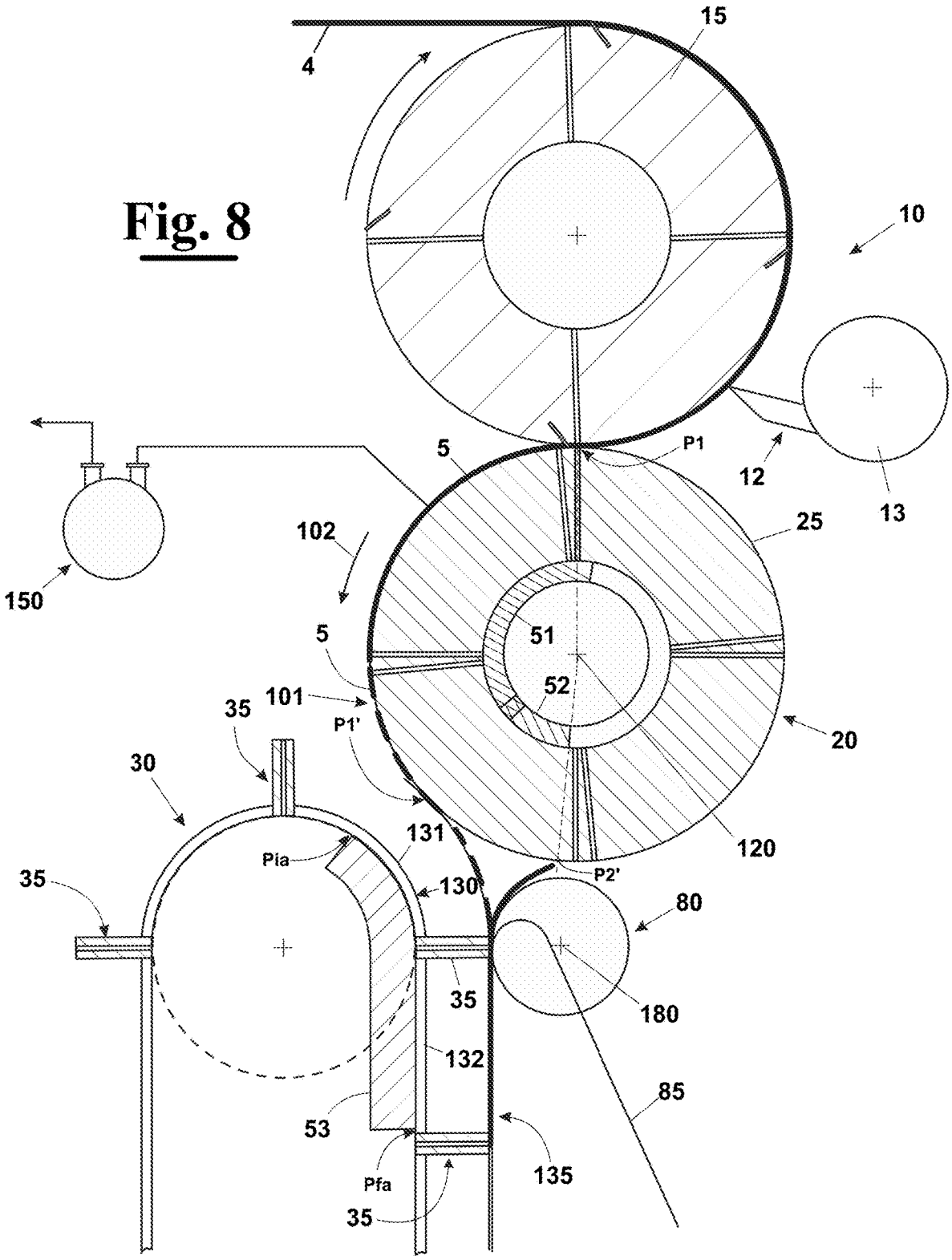

In an embodiment of the invention, the transfer roll 20 is configured to suck each head edge 5*a* and each tail edge 5*b* of the sheets 5 coming from the cutting group 10 at a catching point P1. In particular, the transfer roll 20 is configured to release each head edge 5*a* of the sheets 5 at a first releasing point P1' and each tail edge 5*b* of the sheets 5 same at a second releasing point P2' positioned downstream of the first releasing point P1' going in the direction of rotation 102 of the transfer roll 20 about the longitudinal rotation axis 120. More in particular, the actuation group 50 can comprise a first actuation device 51 configured to put in suction each first longitudinal row of suction holes 62*a* of each suction group 60*a*-60*d* at least between the catching point P1 and the first releasing point P1' going in the direction of rotation 102 of the transfer roll 20 about the longitudinal rotation axis 120. The actuation group 50 can comprise, furthermore, a second actuation device 52 to put in suction the or each second longitudinal row of holes 62*b* of each suction group 60*a*-60*d* at least between the catching point P1 and the second releasing point P2' going in the direction of rotation 102 of the transfer roll 20 about the longitudinal rotation axis 120. In particular, the first and second actuation devices 51 and 52 can comprise a respective suction device configured to pneumatically connect the aforementioned first and second longitudinal rows of suction holes 62*a* and 62*b* with a device for generating a predetermined sucking force 150, for example a vacuum pump, or a liquid-ring compressor, or analogous devices (see FIG. 8). For example, the first and second suction devices 51 and 52 can provide bell-shaped vacuum distributors, of known type, or comprising sealing members of the type, for example described in EP1457444B1, or a combination of the two technical solutions, for example the first suction device 51 provides sealing members of the type described in EP1457444B1 and the second suction device 52 a bell-shaped vacuum distributor.

In particular, the transfer roll 20 and the displacement group 30 are configured in such a way that the transfer of a head edge 5*a* of a sheet of paper 5 from the transfer roll 20 to the displacement group 30 occurs when the catching members 35 reaches a position of the curvilinear portion 131 of the aforementioned movement trajectory 130 where the end of the catching members 35 same is oriented tangentially to the first releasing point P1' positioned along the curvilinear portion 131 of the movement trajectory 130.

In an embodiment of the invention, diagrammatically shown in the figures from 1 to 9 the catching member 35 protrudes for a predetermined height L from a motion transmission member 90, in particular a motion transmission member of flexible type, such as a chain, or a belt, or a transmission tape moved along the movement trajectory 130.

In a possible embodiment of the invention, the motion transmission member 90 is wound, in particular engaged, between a first displacement member 31, which is closer to the transfer roll 20, and a second displacement member 32, which is further away from the transfer roll 20 with respect to the first displacement member 31. In particular, one between the first and the second displacement member 31 and 32 is of motorized type, that means operatively connected to a motor, whilst the other displacement member is of idle type.

Figure 14:
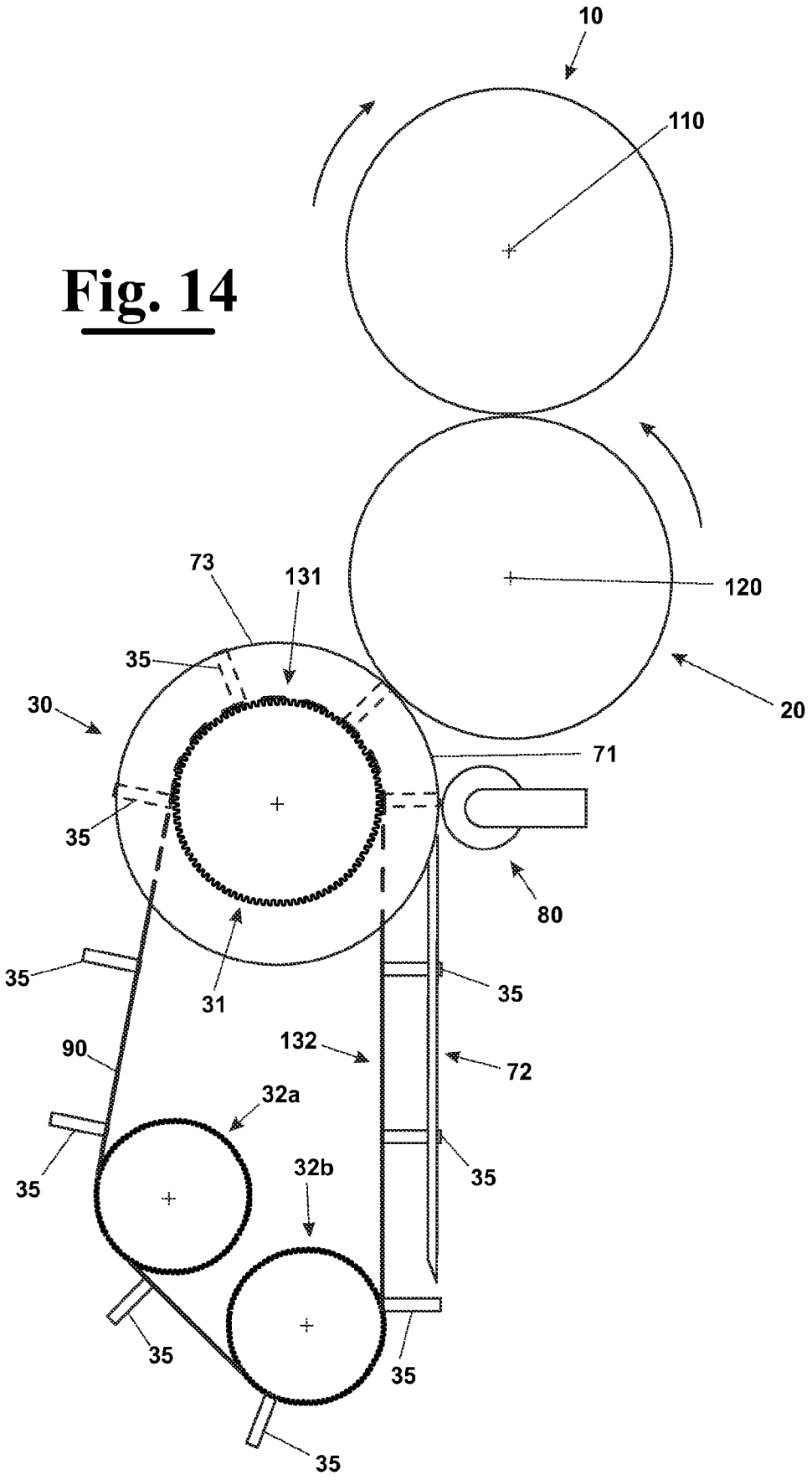
FIG. 14 shows a lateral view of a possible scheme of the advancement unit of FIG. 13.
Figure 15:
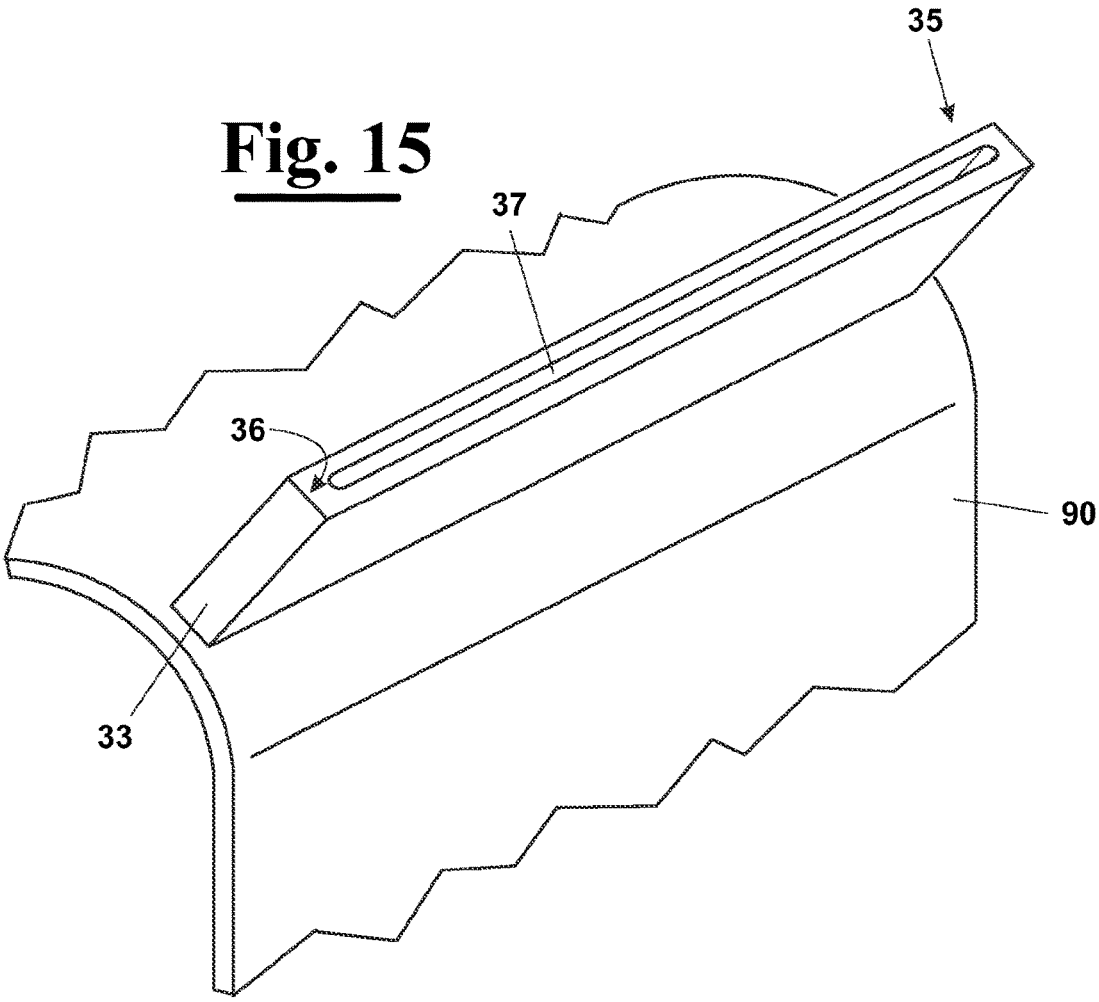
FIG. 15 diagrammatically shows a perspective view of a first embodiment of a catching member that can be adopted in the advancement unit according to the invention.
Figure 16:
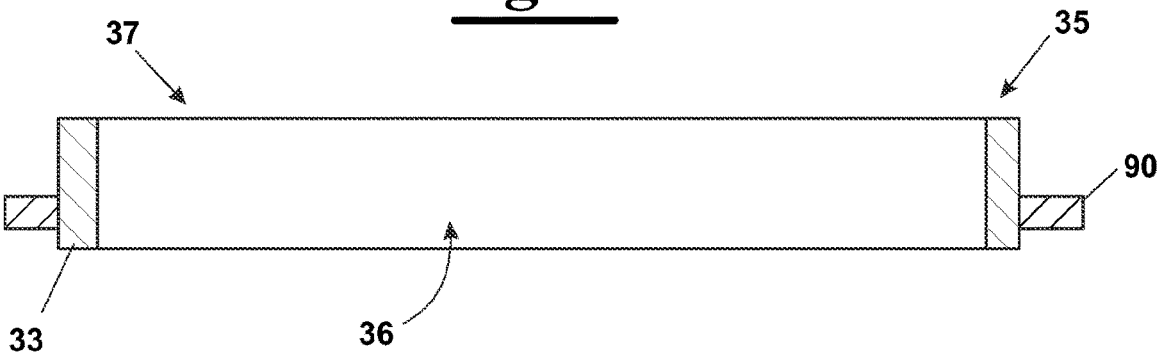
FIG. 16 diagrammatically shows a longitudinal section view of the catching member of FIG. 12.
Figure 17:
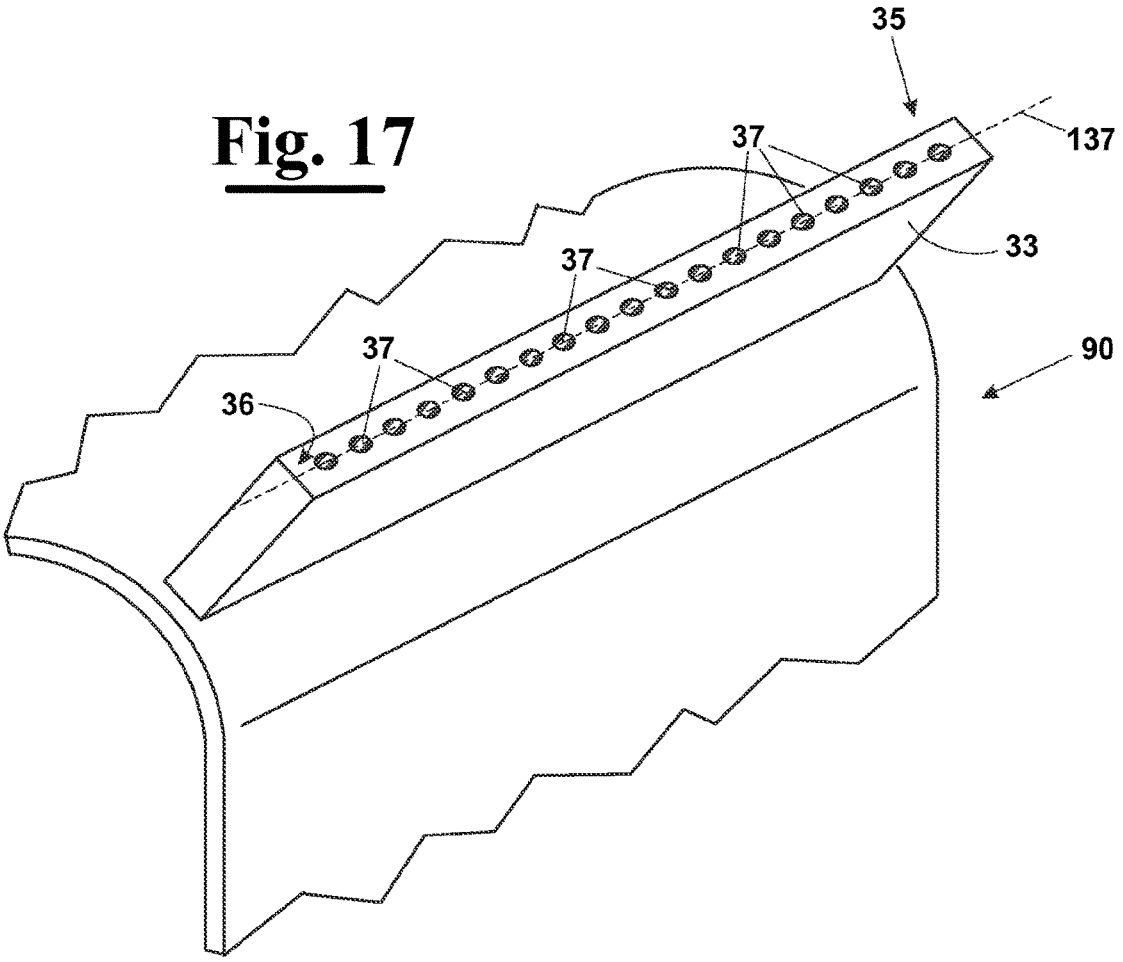
FIG. 17 diagrammatically shows a perspective view of a possible alternative embodiment of the catching member of FIG. 15.

In the alternative embodiment that is diagrammatically shown in FIG. 14, a first displacement member 31, for example motorized, a second and a third displacement member 32*a* and 32*b* for example of idle type, are provided. In this case, the movement trajectory 130 will be therefore defined by the 3 displacement members 31, 32*a* and 32*b*.

In particular, the curvilinear portion 131 of the movement trajectory 130 can be formed at least partially by the first displacement member 31. In particular, the velocity of rotation vpp of the first displacement member 31 can be comprised between ⅓ and ⅔ of the velocity of rotation vtr of the transfer roll 20, i.e. $\frac{1}{3}\cdot vtr \leq vpp \leq \frac{2}{3}\cdot vtr$.

In a possible embodiment, the radius r of the first displacement member 31 plus the predetermined length H of the catching member 35 is substantially equal to the radius R of the transfer roll 20.

Generally, it is possible to change the angular velocity of the first displacement member 31 vpp and/or the length H of the catching member 35 while remaining the condition that the tangential speed of the outermost end of the catching member 35 is less than or equal to the tangential speed of the transfer roll 20. Preferably, when the tangential speed of the transfer roll 20 is higher than the tangential speed of the outermost end of the catching member 35, the transfer roll 20 comprises the recessed portions 65*a*-65*c*. In this case, the transfer of the head edge 5*a* of the sheets 5 from the transfer roll 20 to the catching member 35 in the first releasing point P1', occurs with a sudden slowing down of the head edge 5*a* of the sheets 5 thus forming a bend of the sheet which is received and controlled by the recessed portions 65*a*-65*c*.

In an alternative embodiment of the invention, but not shown in the figure for simplicity, each catching member 35 can be associated to a respective linear motor and independently guided along a guide. These slide guiding systems also called multi-carrier, are known for example with the names "I-Track" of the Rockwell Automation Inc. or "SuperTrack" of the B&R Industrial Automation Gmbh or "Lexium" of the Schneider Electric. In this specific solution, it is possible to change the dynamics of movement of each catching member 35 making the machine more flexible according to a product change as for example the adjustment of the length of a panel 1, or the adjustment of the quantity of overlapping between one sheet 5 and another.

In another solution in order to independently displace one or more catching members 35, also this not shown in the figures for simplicity, a first plurality of displacement members 31 coaxial to each other and a second plurality of displacement members 32 coaxial to each other can be provided. Only one displacement group 30 can be formed by a distal displacement member 32 and a proximal displacement member 31, where distal and proximal have to be intended, respectively, as more distant and closer to the transfer roll 20, can be independently motorized in order to guide a respective motion transmission member 90 to which at least a catching member 35 is associated to.

Preferably, to independently move each following catching member 35, it is possible to associate each following catching member 35 to a different motion transmission member 90.

Each catching member 35 can be provided with a predetermined number of catching holes 37 positioned along a catching direction 137 parallel to the longitudinal rotation axis 120 of the transfer roll 20.

In particular, the displacement group can be associated to a third suction device 53 which pneumatically connects the aforementioned plurality of catching holes 37 of each catching member 35 to a device for generating a predetermined vacuum degree between a suction start point Pia, for example positioned along the curvilinear portion 131 of the movement trajectory 130, and a suction ending point Pfa, for example positioned along the straight portion 132 of the movement trajectory 130. For example, the third suction device 53 can be a suction box communicating pneumatically with the aforementioned device for generating a predetermined vacuum degree. Alternatively, the suction ending point can be positioned along the curvilinear portion defined by the distal pulley 72. Preferably, the suction ending point Pfa can be positioned at a point of the movement trajectory 130 where the catching member 35 does not apply anymore a dragging force on the sheet 5.

In an embodiment foreseen, the displacement group 30 comprises a guiding group 70 configured to guide the sheets of paper 5 held by the catching members 35.

In particular, the guiding group 70 can comprise a curvilinear portion 71, advantageously coaxial to the curvilinear portion 131 of the movement trajectory 130, and a rectilinear portion 72, advantageously parallel to the straight portion 132 of the movement trajectory 130 same. More in particular, the guiding group 70 can be positioned at the base of the protruding members 35 or at a distance from this that is equal to, or greater than, the aforementioned height L of the catching members 35. As diagrammatically shown in the figures from 12 to 14, in an embodiment foreseen, the curvilinear guide portion 71 of the guiding group can be coincident with the external surface of a guiding roll 73. This is configured to rotate about a longitudinal rotation axis 173 parallel to the longitudinal rotation axis 120 of the transfer roll 20.

In particular, the guiding roll 73 can be provided with a plurality of suction holes 77 configured to suck, for example by connecting the same to a device for generating a predetermined vacuum degree, at predeterminate angular positions. The aforementioned aligned with the suction holes 77 are, advantageously, holes 37 of the catching members 35 at least at the curvilinear portion 131 of the movement trajectory 130.

Figure 12:
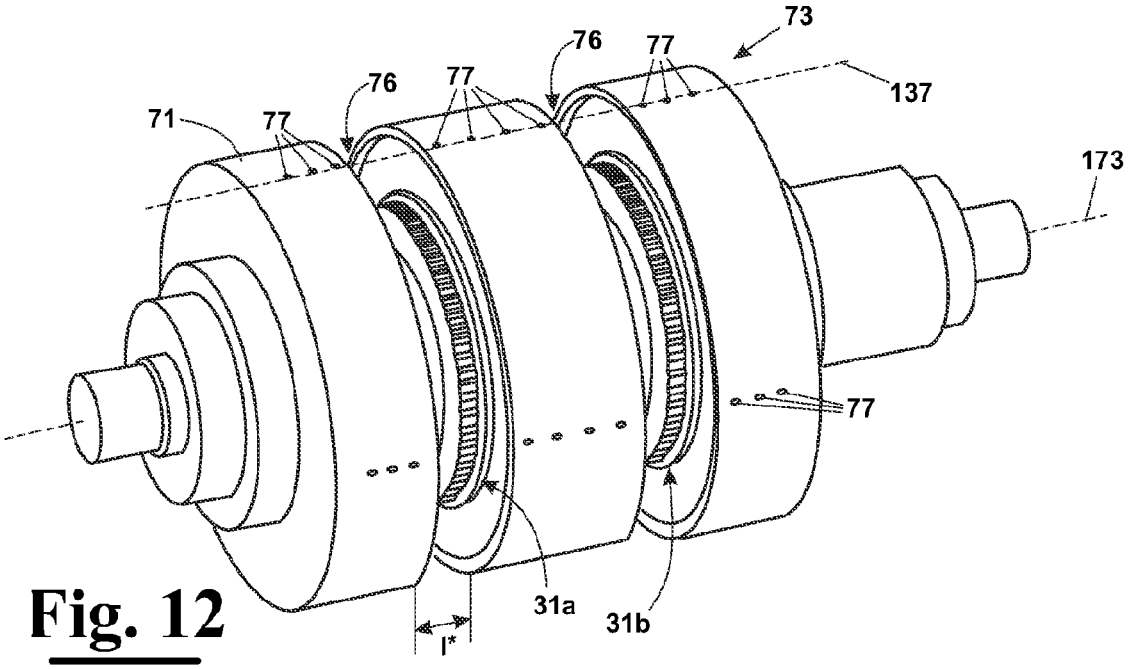
FIG. 12 diagrammatically shows a perspective view, a first embodiment of a displacement group that can be used in the advancement unit according to the invention.
Figure 13:
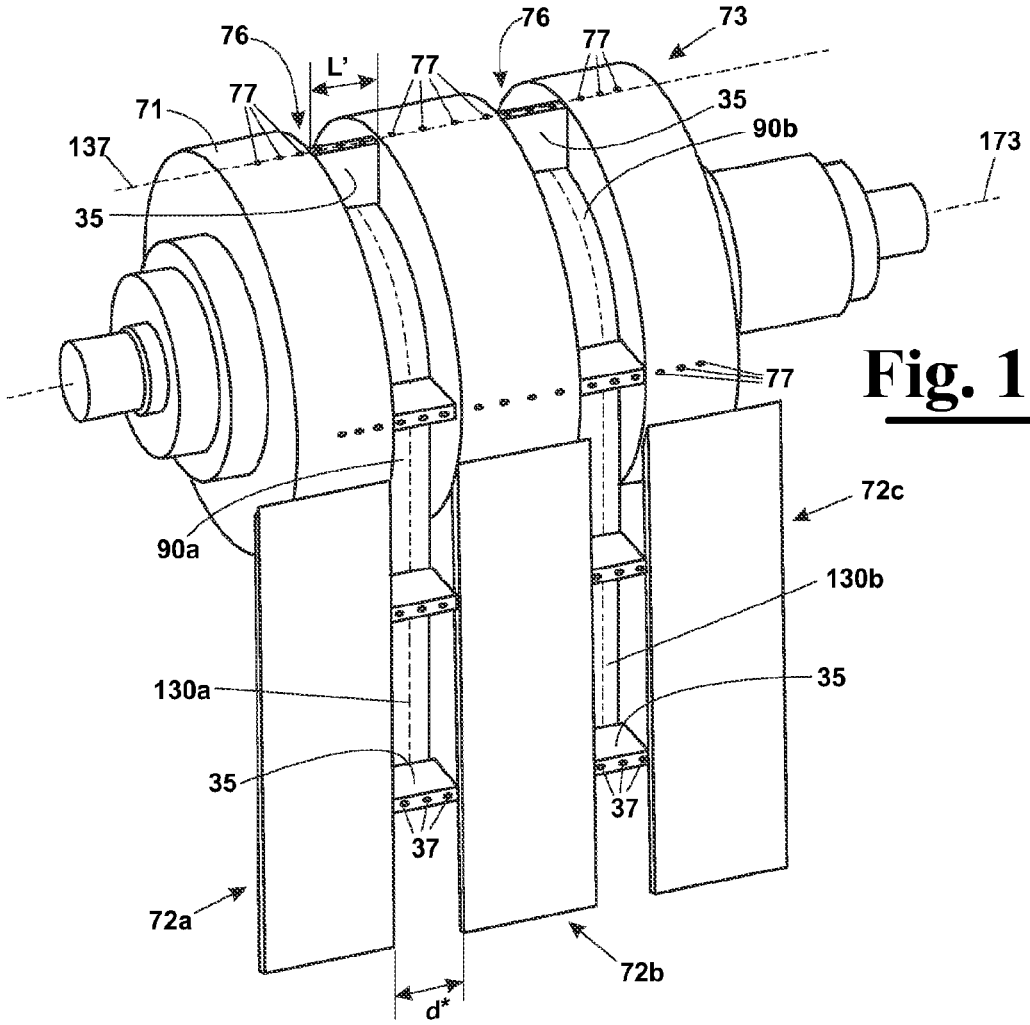
FIG. 13 diagrammatically shows a perspective view of an advancement unit, according to the invention, provided with the embodiment of the displacement group of FIG. 12.

More in particular, the aforementioned plurality of catching members 35 can be engaged to at least a motion transmission member 90, in the case of FIG. 13, a first and a second motion transmission member 90*a* and 90*b* moved along respective trajectories of movement 130*a* and 130*b* laying on planes parallel to each other. The or each motion transmission member 90, 90*a*, 90*b*, can be of flexible type, for example can provide a respective transmission belt, and can be wound around a displacement member 31, for example a toothed disc, or a toothed pulley, in the case of FIGS. 12 and 13 a first and a second toothed wheels 31*a* and 31*b*.

In a possible embodiment of the invention, the displacement member 31 can be housed within a circumferential groove or race 76 made in the guiding roll 73 having a width l* substantially equal to or greater than the width L' of the catching members 35. Therefore, in this case, each catching member 35 is adapted to be moved along the curvilinear portion 131 of a respective movement trajectory 130 defined by the respective motion transmission member 90, 90*a*, and 90*b*. In this way, it is possible to guarantee that the guide roll 73 and the catching members 35 are synchronously moved that means in phase with each other.

Downstream of the guide roll 73, and, therefore, of the curvilinear portion 71 of the guiding group 70, the aforementioned rectilinear portion 72 is provided. This, as diagrammatically shown in FIG. 13, can comprise a plurality of substantially flat elements 72, for example a first, a second and a third substantially flat element 72*a*, 72*b* and 72*c*. In particular, these can be positioned at a distance d* one from the other along a direction parallel to the longitudinal rotation axis of the transfer roll 20, greater than a width L' of the aforementioned catching members 35. In particular, during the movement of the catching members 35 along the respective straight portion 132 of the respective movement trajectory 130, each catching member 35 is adapted to slide between two successive substantially flat guide members 72*a* and 72*b*, or 72*b* and 72*c*. In particular, the aforementioned width l* of the circumferential groove 76 can be equal to or substantially equal to the aforementioned distance d* between two rectilinear planar elements 72*a*, 72*b* and 72*c*.

Figure 19:
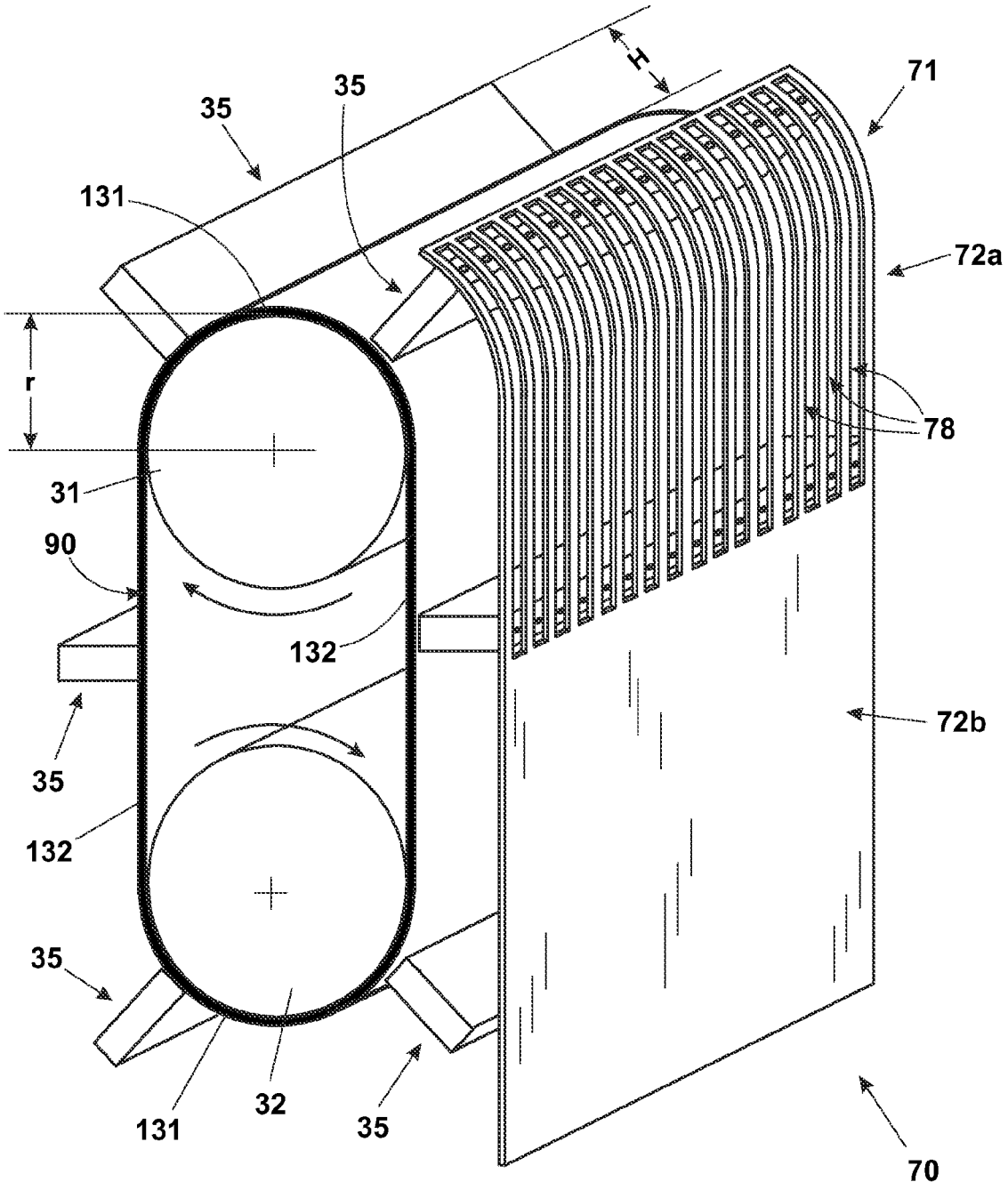
FIG. 19 diagrammatically shows a side elevation perspective view a of possible embodiment of a displacement group according to the invention.
Figure 20:
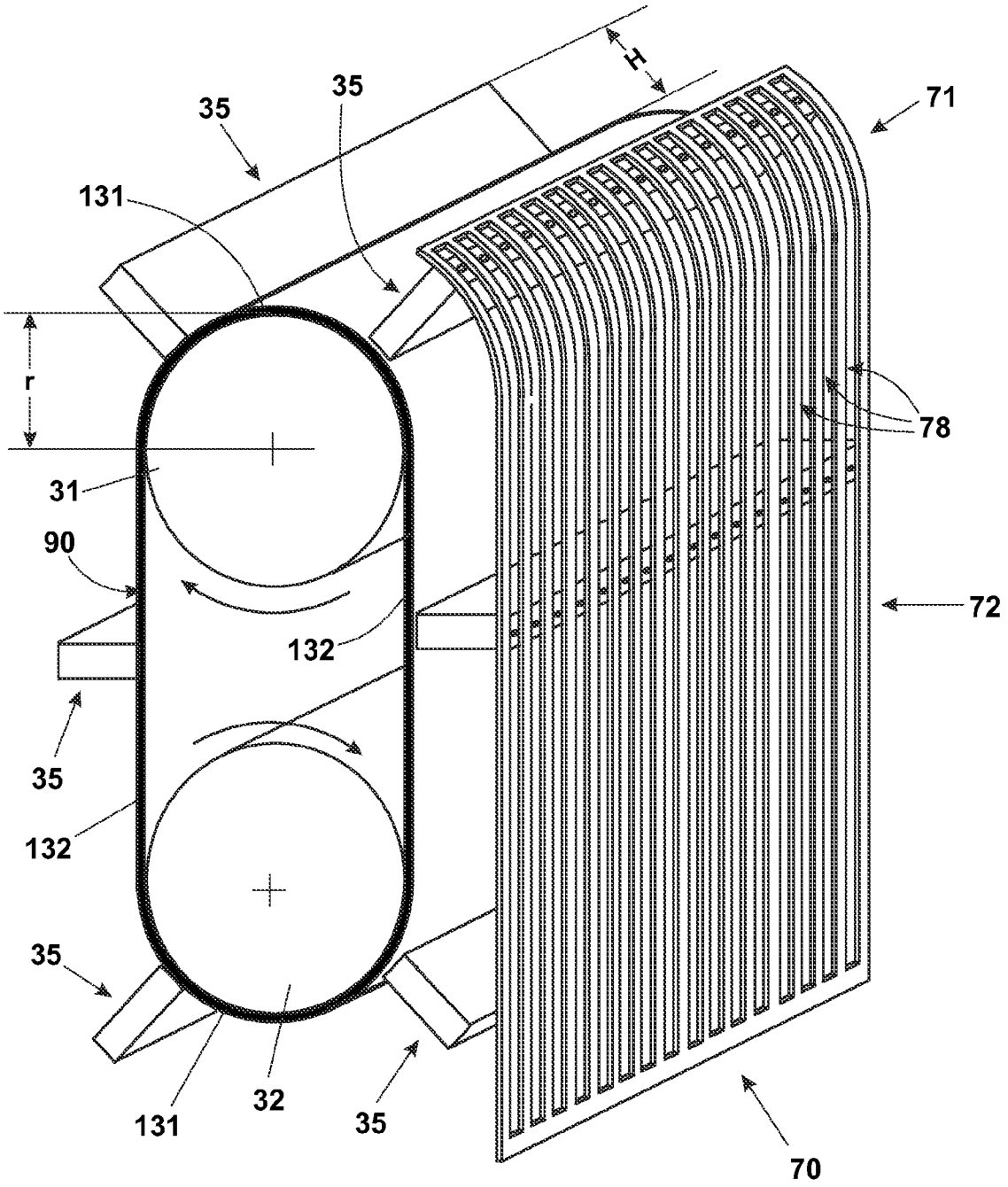
FIG. 20 diagrammatically shows a side elevation perspective view of another alternative embodiment of a displacement group according to the invention.

In an alternative embodiment of the invention, diagrammatically shown in the FIGS. 19 and 20, the guiding group 70 can provide at least a shaped plate provided with at least an aperture 78, advantageously positioned at the or each suction hole 37 of the catching members 35, in such a way to allow the same to exert the suction action on the worked sheets of paper 5.

In particular, in the embodiment of FIG. 19, the shaped plate 70 can comprise a curvilinear guiding portion 71 provided with the or each aperture 78 and a rectilinear guiding portion 72 positioned downstream of the curvilinear guiding portion 71 and which extends substantially up to the aforementioned suction ending point Pfa. In this case, the aforementioned apertures 78 substantially extend for all the length of the shaped guiding plate.

Figure 25:
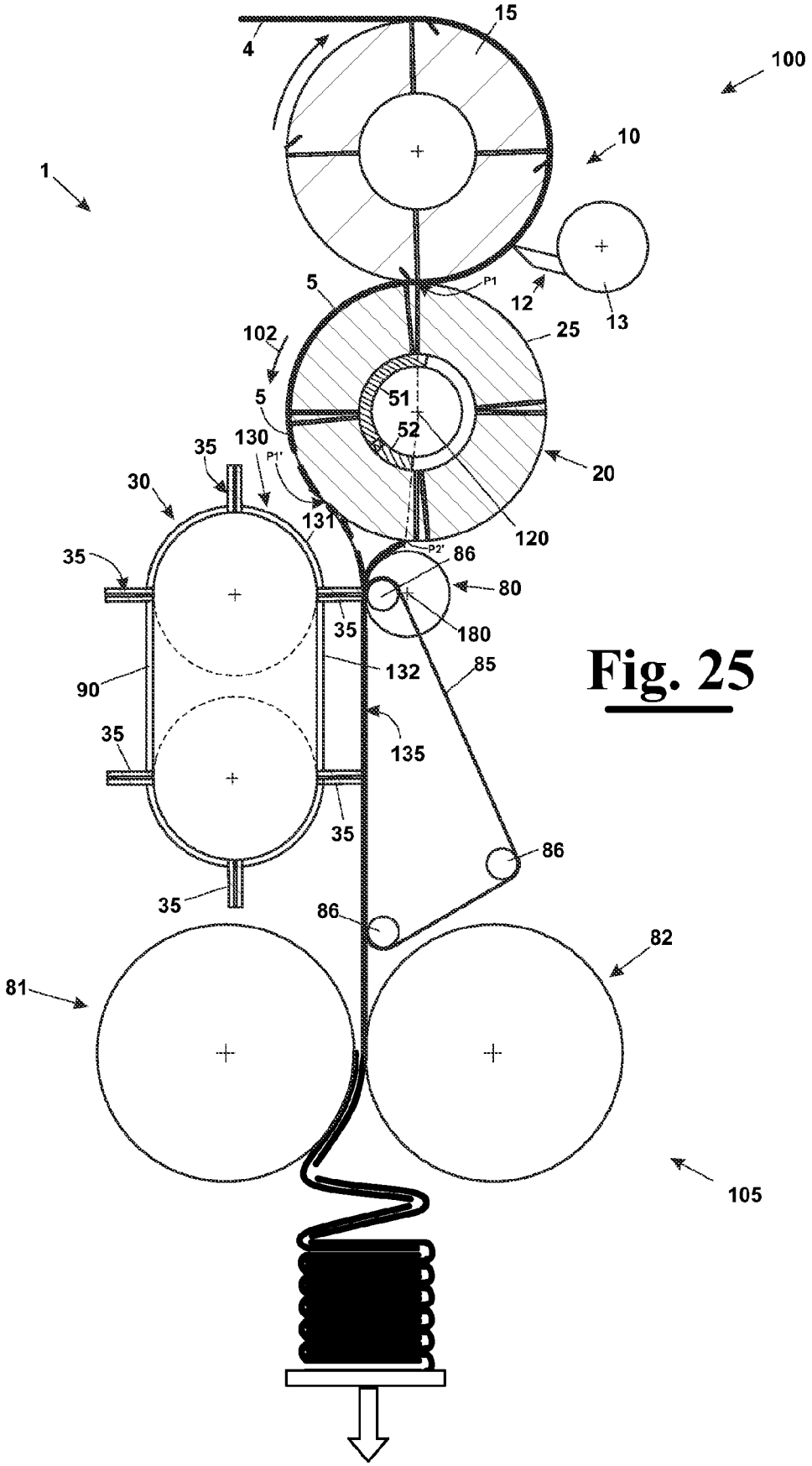
FIG. 25 diagrammatically shows a side elevation view partly sectioned of a machine for paper converting which adopts the advancement unit according to the invention.

In the alternative embodiment of the invention of FIG. 25, instead, the rectilinear guiding portion 72 comprises a first rectilinear guiding portion 72*a* provided with the aforementioned aperture 78 and a second rectilinear guiding portion 72*b* without apertures 78 positioned downstream of the first rectilinear guiding portion 72*a*. More precisely, the second rectilinear guiding portion 72*b* is adapted to cooperate with an advancement member 85 to cause the sheets of paper 5 to move downstream of the suction ending point Pfa.

Figure 18:
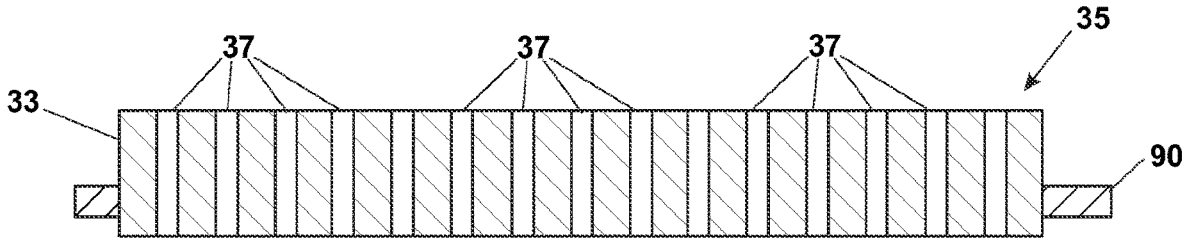
FIG. 18 diagrammatically shows a longitudinal section view of the catching member of FIG. 17.

In particular, the advancement member 85, preferably of flexible type, for example a transmission belt wound around a series of pulleys 86, is adapted to cooperate with the guiding group 70 to cause the sheets of paper 5 to move downstream of the first releasing point P1' by the transfer roll 20. More in particular, the advancement member 85 can be adapted to cause, or to help, the sheets of paper 5 to advance in the superimposed configuration when the catching members 35 are moved along the straight portion 132 of the movement trajectory 130. Advantageously, the advancement member 85 can be adapted to cause the sheets of paper 5 to advance also downstream of the suction ending point Pfa, for example in order to cause the same to move to a following working unit, for example a folding unit as described in the following with reference to FIG. 18.

As diagrammatically shown in the figures from 1 to 11B and 14, the displacement group 30 can comprise, furthermore, an auxiliary roll 80 adapted to rotate about a respective longitudinal rotation axis 180 at a predetermined third angular velocity ω3 in such a way to have a tangential speed vt which is substantially equal to the advancement speed of the catching members 35 at least along the straight portion 132 of the movement trajectory 130.

Figure 21:
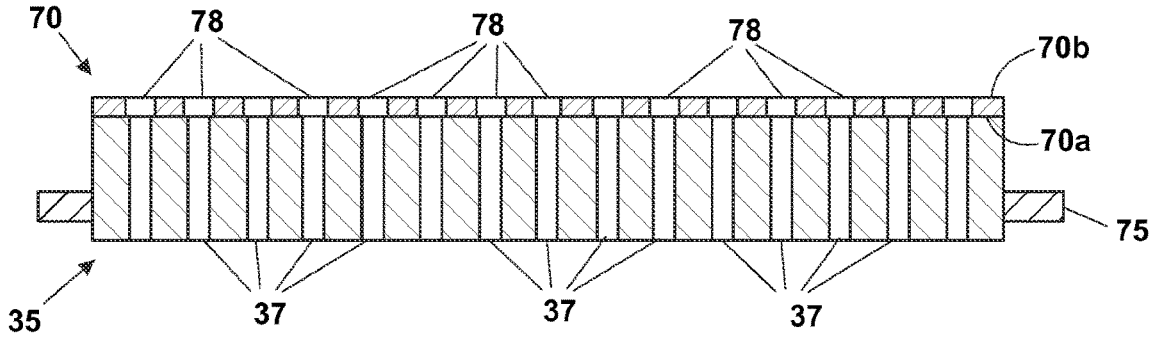
FIG. 21 shows a longitudinal section view of an embodiment provided for the catching members and the guide wall.

In particular, as diagrammatically shown in FIG. 21, in working conditions, each catching member 35 can be arranged adjacent to the face 70*a* of the shaped guiding plate 70 opposite to the face 70*b* which faces towards the worked sheet 5.

Figure 22:
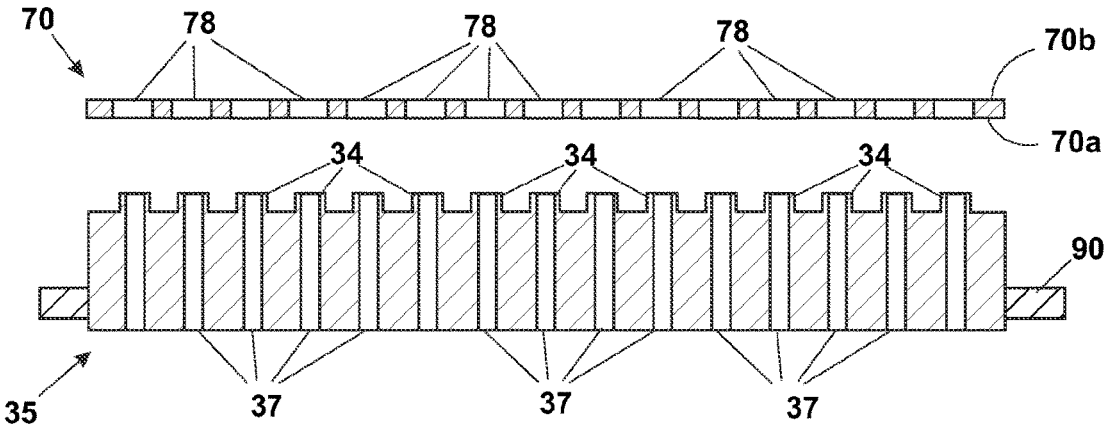
FIGS. 22 and 23 show longitudinal section views of an alternative embodiment of the catching members and the guide wall of FIG. 21, respectively, in an exploded configuration and in an assembled configuration.
Figure 23:
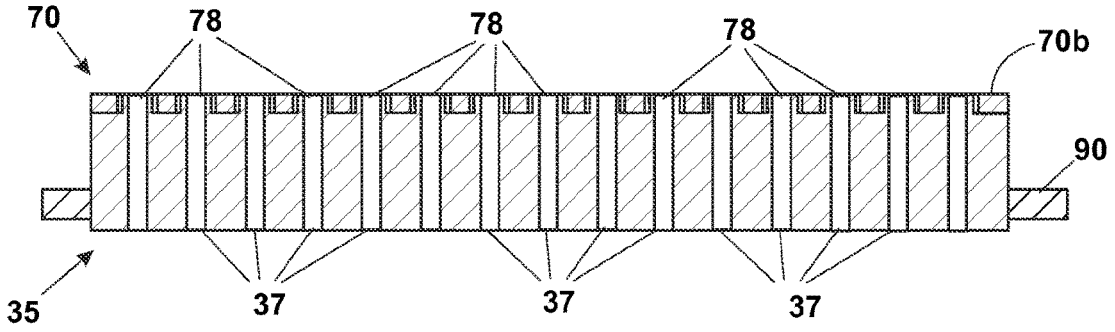

In the alternative embodiment diagrammatically shown in the FIGS. 22 and 23, instead, each catching member 35 is provided with an end portion 34 for each catching hole 37 protruding from the resto of the main body of the catching member 35. More precisely, in use, each end portion is adapted to be housed into a respective aperture 78 of the guiding group 70. Therefore, in this case, the catching holes 37 are positioned substantially at the same level with the aforementioned face 70*b*, or slightly protruding from this.

Figure 24:
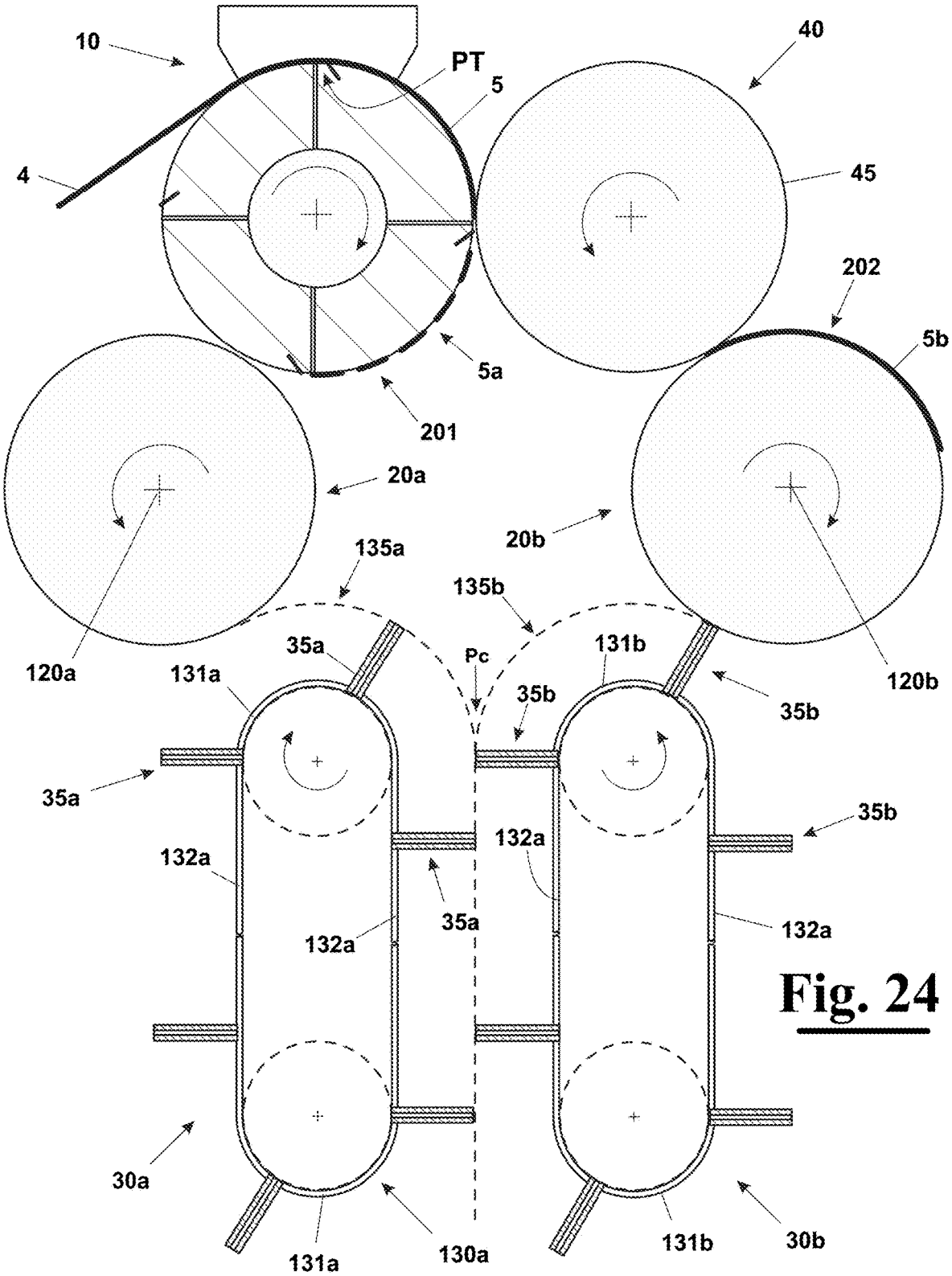
FIG. 24 diagrammatically shows a side elevation view partly sectioned of a further embodiment of the advancement unit according to the invention.

In the alternative embodiment which is diagrammatically shown in FIG. 24, the advancement unit 1 comprises a first and a second transfer roll 20*a* and 20*b* each of which associated to a respective displacement group 30*a* and 30*b*. In particular, each displacement group 30*a* and 30*b* can be provided, respectively, with a respective plurality of catching members 35*a* and 35*b* each of which moved along a respective movement trajectory 130*a* and 130*b*. More precisely, the sheets of paper 5 obtained by cutting the web 4 at the cutting roll 15, are fed downstream of the same along a first and a second feeding line 201 and 202.

More in detail, all the cut sheets 5 cover a first portion of the surface of the cutting roll 15 which extends starting from a cutting point PT up to a contact point of the cutting roll 15 with a path adjustment roll 40. This is adapted to increase the path that is covered by the sheets of paper 5 along the second feeding line 202 of a portion of predetermined length, or increment, with respect to the track covered by the sheets 5 of the first feeding line 201. In other words, the track covered by the sheets of paper 5*b* along the second feeding line 202 will be equal to the path L1 which is covered by the sheets of paper 5 along the first feeding line plus the aforementioned increment. This latter determines the length of the fraction of length l of sheets 5 overlapping each other. In particular, the sheets 5*b* are caused to move along the second feeding line 202 at a second predetermined advancement speed v2, in particular a tangential speed.

If the sheet 5 is directed along the first feeding line 201 it continues to adhere to the surface 16 of the cutting roll 15 up to the point of tangency of this with the first transfer roll 20*a* and then moves to the first displacement group 30*a* according to the procedures described above with reference to the figures from 1 to 16. In this way, the sheet of paper 5 is fed along a first feeding direction 201. If, instead, the sheet of paper 5 is directed along the second feeding line 202, it covers only the first portion of the surface 16 of the cutting roll 15, i.e. that one comprised between the cutting point PT and the point of tangency with the path adjustment roll 40 to pass then on this latter and cover a portion of its surface 45 that, once covered, the sheet of paper 5 moved to the second transfer roll 20*b* and, therefore, to the second displacement group 30*b*.

In this way, along each feeding line 201 and 202, the sheets of paper 5 arrives at the respective displacement group 30*a* and 30*b* in a determined partly overlapped configuration and then reaches a point of intersection PC of the two lines 201 and 202, arranged in a desired position staggered with respect to each other. In order to obtain this result, the sheets 5*b* which move along the second feeding line 202 cover a path longer than the path covered by the sheets 5 which are fed along the first feeding line 201.

As diagrammatically shown in FIG. 25, according to another aspect of the invention, an interfolding machine 100 for producing folding or interfolding products comprises an advancement unit 1 as described above with reference to the figures from 1 to 17 and a folding unit 105, for example comprising a couple of folding rolls 81 and 82 counter-rotating with respect to each other and positioned downstream of the same. The folding rolls 81 and 82, for example of the type described in EP1477447, are adapted to fold the sheets 5 coming from the advancement unit 1 in a predetermined folding for interfolding configuration forming a corresponding stack 150 of folding or interfolding sheets. This latter alternative embodiment of the advancement unit 1 can be, in particular, used to obtain packages of folded or interfolded products with 3 or 4 panels.

In the embodiments described above with reference to the figures from 1 to 21, the cutting group 10 can be configured to divide the continuous web 4 into sheets 5 of length L equal to an integer multiple of a predetermined length P of a panel, preferably from 2 to 6 times the aforementioned length of a panel. In particular, the distance between 2 successive catching members 35 along the motion transmission member 90 can be less than the length of the sheets of paper 5, preferably less than one or more of the aforementioned lengths P of a panel. More precisely, with the word "panel" it is intended each portion of sheet obtained by folding a sheet a determined number of times.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. An advancement unit configured to cause a plurality of sheets of paper, or other material permeable to air, of a predetermined length, to move along a predetermined advancing direction in a machine for paper converting, each sheet of said plurality having a head edge and a tail edge, said advancement unit comprising:

a cutting group configured to divide a web made of paper, or another material permeable to air, into said plurality of sheets;

a transfer roll positioned downstream of said cutting group and having an external surface, said transfer roll being configured to rotate at a first predetermined angular velocity (ω1) about a longitudinal rotation axis and to hold, alternately, on a first and on a second predetermined portion of said external surface respectively said head edge and said tail edge of said plurality of sheets coming from said cutting group, in such a way to cause said sheets to be transferred at a first predetermined tangential speed (v1);

wherein said advancement unit furthermore, provides:

a displacement group positioned downstream of said transfer roll and configured to move a plurality of catching members along a movement trajectory comprising at least one curvilinear portion and at least one straight portion, each catching member being configured to hold a respective head edge of a sheet during the movement of the same along said predetermined movement trajectory, in such a way to move said plurality of sheets in a partly overlapped configuration along a predetermined advancement trajectory;

wherein said curvilinear portion of said movement trajectory is positioned upstream of said straight portion;

wherein said plurality of catching members are moved along said curvilinear portion at a second tangential speed (v2) less than or equal to said first tangential speed (v1);

and wherein each catching member comprises a main body provided with at least a catching hole configured to suck said head edge of a respective sheet of said plurality and to hold the head edge on a predetermined advancement trajectory during said movement of said respective catching member along said movement trajectory.

2. Advancement unit according to claim 1, wherein said transfer roll comprises:

a tubular body provided with said external lateral surface and with an internal lateral surface pneumatically connected with each other through a plurality of suction holes organized according to a plurality of suction groups each of which comprising a first longitudinal row of suction holes adapted to suck said head edge of a sheet and at least a second longitudinal row of suction holes adapted to suck a tail edge of a previous sheet of said plurality;

an actuation group configured to cause said first and second longitudinal rows of suction holes to suck said sheets and to cause the same to adhere at corresponding portions of said external lateral surface of said transfer roll, only at predetermined respective angular positions of said tubular body.

3. Advancement unit according to claim 2, wherein said transfer roll comprises a recessed portion at said external surface positioned upstream of each said first longitudinal row of suction holes going in the direction of rotation of said transfer roll about said longitudinal rotation axis.

4. Advancement unit according to claim 2, wherein said transfer roll is configured to suck each head edge and each tail edge of said plurality of sheets of paper coming from said cutting group at a catching point (P1), and to release each head edge of said sheets at a first releasing point (P1') and each tail edge of said plurality of sheets at a second releasing point (P2') positioned downstream of said first releasing point (P1') going in said direction of rotation of said transfer roll about said longitudinal rotation axis.

5. Advancement unit according to claim 4, wherein said transfer roll and said displacement group are configured in such a way that said transfer of a head edge of a sheet from said transfer roll to said displacement group occurs when said catching members reaches said first releasing point (P1') positioned along said curvilinear portion di said movement trajectory.

6. Advancement unit according to claim 4, wherein said curvilinear portion of said movement trajectory is tangent to said transfer roll at said first releasing point (P1').

7. Advancement unit according to claim 4, wherein said actuation group comprises:

a first actuation device configured to selectively cause a respective head edge of said plurality of sheets to be sucked by each said first longitudinal row of suction holes of each suction group at least between said catching point (P1) and said first releasing point (P1') going in the direction of rotation of said transfer roll about said longitudinal rotation axis;

a second actuation device configured to cause each said second longitudinal row of suction holes of each suction group to suck at least between said catching point (P1) and said second releasing point (P2') going in the direction of rotation of said transfer roll about said longitudinal rotation axis.

8. Advancement unit according to claim 7, wherein said displacement group is provided with a third actuation device configured to selectively cause said sheets to be sucked by said holes of said catching members between a suction start point (Pia) positioned along said curvilinear portion of said movement trajectory and a suction ending point (Pfa) positioned along said straight portion of said movement trajectory.

9. Advancement unit according to claim 4, wherein the tangential speed of said catching members in said first releasing point (P1') is slower than or equal to the tangential speed of said transfer roll.

10. Advancement unit according to claim 1, wherein each said catching member is adapted to protrude for a predetermined height (L) from a motion transmission member moved along said movement trajectory, each said catching member comprising a plurality of catching holes positioned along a catching direction parallel to said longitudinal rotation axis of said transfer roll.

11. Advancement unit according to claim 10 wherein said motion transmission member is of flexible type and is adapted to be wound between a first displacement member and at least a second displacement member, and wherein one between said first and second displacement members is operatively connected to a motor.

12. Advancement unit according to claim 11, wherein said curvilinear portion of said movement trajectory is formed at least partly by said first displacement member.

13. Advancement unit according to claim 11, wherein the velocity of rotation (vpp) of said first displacement member is comprised between ⅓ and ⅔ of the velocity of rotation (vtr) of said transfer roll, i.e. $\frac{1}{3}(vtr) \leq vpp \leq \frac{2}{3}(vtr)$.

14. Advancement unit according to claim 10, wherein said sheets have a length equal to an integer multiple of a length (P) of a panel, and wherein the distance between two successive catching members of said plurality on said motion transmission member is less than the length of said sheets.

15. Advancement unit according to claim 14, wherein said sheets have a length equal to an integer multiple of a length (P) of a panel comprised from 2 times of the length (P) of a panel and 6 times of the length (P) of the panel, and wherein the distance between two successive catching members of the plurality on said motion transmission member is less than a quantity equal to one or more lengths (P) of a panel.

16. Advancement unit according to claim 1, wherein said displacement group comprises a guiding group configured to guide said sheets which are held by said catching members, said guiding group comprising:

a curvilinear portion coaxially arranged to said curvilinear portion of said movement trajectory; and a rectilinear portion parallel to said straight portion of said movement trajectory.

17. Advancement unit according to claim 16, wherein said curvilinear portion of said guiding group coincides with the external surface of a guiding roll configured to rotate about a longitudinal rotation axis parallel to said longitudinal rotation axis of said transfer roll.

18. Advancement unit according to claim 17, wherein said guide roll is provided with at least a circumferential groove at which a first displacement member is adapted to be positioned, wherein each said catching member is adapted to protrude for a predetermined height (L) from a motion transmission member moved along said movement trajectory, and wherein said motion transmission member is configured to engage on said first displacement member in such a way to be moved along a respective movement trajectory.

19. Advancement unit according to claim 16, wherein an advancement member is, furthermore, provided configured to cooperate with said guiding group in such a way to cause said plurality of sheets of paper to move forward also downstream of a suction ending point (Pfa) positioned along said straight portion of said movement trajectory.

20. Advancement unit according to claim 1, wherein an auxiliary roll is, furthermore, provided adapted to rotate about a respective longitudinal rotation axis at a predetermined angular velocity ($\omega 3$) such to have a tangential speed (vt) substantially equal to said advancement speed of said catching members at least along said straight portion of said movement trajectory.

21. Advancement unit according to claim 1, characterised in that it furthermore comprises:

a first transfer roll positioned downstream of the cutting group and having an external surface, wherein the first transfer roll is configured to rotate at a first predetermined angular velocity ($\omega 1$) about a longitudinal rotation axis and to hold, alternately, on a first and on a second predetermined portion of said external surface respectively said head edge and said tail edge of a first plurality of sheets of paper coming from said cutting group, in such a way to cause said sheets to be transferred at a first predetermined tangential speed (v1) along a first feeding line;

a first displacement group positioned downstream of the first transfer roll and configured to move a first plurality of catching members along a first movement trajectory comprising at least one curvilinear portion and at least one straight portion, wherein each catching member is configured to hold a respective head edge of a sheet of paper during the movement of the same along the first predetermined movement trajectory, in such a way to move the first plurality of sheets of paper in a partly overlapped configuration along a first predetermined advancement trajectory;

a second transfer roll positioned downstream of the cutting group and having an external surface, wherein the second transfer roll is configured to rotate at a first predetermined angular velocity ($\omega 1$) about a longitudinal rotation axis and to hold, alternately, on a first and on a second predetermined portion of said external surface respectively said head edge and said tail edge of a second plurality of sheets of paper coming from said cutting group, in such a way to cause said sheets of paper to be transferred at a second predetermined tangential speed (v2) along a second feeding line;

a second displacement group positioned downstream of said second transfer roll and configured to move a second plurality of catching members along a second movement trajectory comprising at least one curvilinear portion and at least one straight portion, wherein each catching member is configured to hold a respective head edge of a sheet of paper during the movement of the same along said second predetermined movement trajectory, in such a way to move said plurality of sheets of paper in a partly overlapped configuration along a second predetermined advancement trajectory.

22. Advancement unit according to claim 21, wherein between said cutting group and said second transfer roll a path adjustment roll is, furthermore, provided adapted to increase the path covered by said second plurality of sheets of paper along said second feeding line of a stretch of predetermined length (ΔL) with respect to a predetermined path (L1) covered by said first plurality of sheets along said first feeding line.

23. Interfolding machine for producing folded or interfolded products, comprising:

an advancement unit according to claim 1;

a couple of folding rolls positioned downstream of said displacement group and adapted to fold or interfold said plurality of sheets of paper at least partly overlapped to each other forming a stack of folded or interfolded sheets.

24. Method for causing a plurality of sheets of paper, or any other material permeable to air, having a predetermined length, to move along a predetermined advancing direction in a machine for paper converting, each sheet of paper of said plurality having a head edge and a tail edge, said method comprising the steps of:

dividing by a cutting group a web of paper into said plurality of sheets;

transferring by a transfer roll positioned downstream of said cutting group and having an external surface said plurality of sheets of paper from said cutting group to a displacement group positioned downstream of said transfer roll, said transfer roll being configured to rotate at a first predetermined angular velocity (ω1) about a longitudinal rotation axis and to hold on a predetermined portion of said external surface said plurality of sheets of paper coming from said cutting group in such a way to cause said transfer to a first predetermined tangential speed (v1);

movement by said displacement group a plurality of catching members along a movement trajectory comprising at least one curvilinear portion and at least one straight portion, each catching member being configured to hold a respective head edge of a sheet of paper during the movement of the same along said predetermined movement trajectory, in such a way to move said plurality of sheets of paper in a partly overlapped configuration along a predetermined advancement trajectory, wherein said curvilinear portion of said movement trajectory is positioned upstream of said straight portion;

wherein said plurality of catching members are moved along said curvilinear portion at a second tangential speed (v2) less than or equal to said first tangential speed (v1);

wherein each catching member comprises a main body provided with at least a catching hole configured to suck said head edge of a respective sheet of said plurality and to hold the head edge on a predetermined advancement trajectory during said movement of said respective catching member along said movement trajectory.

* * * * *